US006439389B1

(12) United States Patent
Mogil

(10) Patent No.: US 6,439,389 B1
(45) **Date of Patent: *Aug. 27, 2002**

(54) PACK ASSEMBLY

(75) Inventor: Melvin S. Mogil, Toronto (CA)

(73) Assignee: California Innovations Inc., Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/617,045

(22) Filed: Jul. 14, 2000

Related U.S. Application Data

(63) Continuation-in-part of application No. 09/568,022, filed on May 10, 2000, now Pat. No. 6,237,776, which is a continuation of application No. 09/122,088, filed on Jul. 24, 1998, now Pat. No. 6,092,661.

(51) Int. Cl.[7] ..... B65D 69/00

(52) U.S. Cl. ..... 206/579; 206/523; 206/315.1; 206/217

(58) Field of Search ..... 206/217, 315.1, 206/545, 547, 549, 579; 62/457.4, 457.5, 457.7; 383/40, 117; 224/153, 584; 190/102, 103, 109, 110

(56) References Cited

U.S. PATENT DOCUMENTS

| | | | | | |
|---|---|---|---|---|---|
| 2,827,096 | A | | 3/1958 | Hinson | |
| 3,001,566 | A | | 9/1961 | Lipsitz | |
| 4,192,365 | A | | 3/1980 | Siegel | |
| 4,378,866 | A | | 4/1983 | Pelavin | |
| 4,468,933 | A | * | 9/1984 | Christopher | 62/457 |
| 4,537,313 | A | | 8/1985 | Workman | |
| 4,673,117 | A | | 6/1987 | Calton | |
| 4,767,039 | A | | 8/1988 | Jacober | |
| D312,530 | S | * | 12/1990 | Gallen et al. | D3/33 |
| 5,022,528 | A | | 6/1991 | Savoy | |
| 5,054,589 | A | | 10/1991 | Bomes et al. | |
| 5,217,119 | A | | 6/1993 | Hollingsworth | |
| 5,228,547 | A | | 7/1993 | Yoo | |
| 5,288,150 | A | | 2/1994 | Bearman | |
| 5,400,610 | A | * | 3/1995 | Macedo | 62/457.7 |
| 5,505,307 | A | | 4/1996 | Shink | |
| 5,567,055 | A | * | 10/1996 | Smith | 190/102 |
| 5,620,140 | A | | 4/1997 | Utter | |
| 5,649,658 | A | | 7/1997 | Hoffman et al. | |
| D387,198 | S | | 12/1997 | Lehmann et al. | |
| 5,775,590 | A | | 7/1998 | Utter | |
| 5,842,571 | A | * | 12/1998 | Rausch | 206/549 |
| 5,884,768 | A | | 3/1999 | Fox | |
| 5,934,527 | A | | 8/1999 | Von Neumann | |
| 5,967,415 | A | | 10/1999 | Utter | |
| D419,770 | S | | 2/2000 | Mogil | |
| D419,830 | S | | 2/2000 | Birutis et al. | D7/607 |
| 6,092,661 | A | | 7/2000 | Mogil | |
| 6,116,045 | A | * | 9/2000 | Hodosh et al. | 62/457.4 |
| 6,237,776 | B1 | * | 5/2001 | Mogil | 206/579 |
| 6,238,091 | B1 | * | 5/2001 | Mogil | 383/110 |

* cited by examiner

*Primary Examiner*—David T. Fidei
(74) *Attorney, Agent, or Firm*—Arent Fox Kintner Plotkin & Kahn, PLLC

(57) ABSTRACT

An insulated pack has a main, insulated compartment suitable for holding refreshments at either a warmed or chilled temperature. The insulated pack has an externally mounted receptacle for carrying a liquid containing vessel, in the nature of a drink bottle or a mister. It also has another compartment for valuables that has receptacles for such objects as cellular telephone handsets, wallets, and keys. It has a reinforced web framework structure, and a carrying handle mounted on the lid. Use of two of these packs, allows a user to keep different objects at different temperatures. The pack is particularly useful for attachment to a golf bag or golf cart to provide cool drinks during a round of golf.

40 Claims, 14 Drawing Sheets

PACK ASSEMBLY

This application is a continuation-in-part of U.S. application Ser. No. 09/568,022 filed on May 10, 2000, now U.S. Pat. Ser. No. 6,237,776 B1, which is a continuation of U.S. application Ser. No. 09/122,088 filed on Jul. 24, 1998, now U.S. Pat. Ser. No. 6,092,661.

FIELD OF THE INVENTION

This invention relates generally to portable packs that include a cooling compartment. In particular it relates to a kind of portable pack that can be used in a number of outdoor activities, such as, for example, while golfing.

BACKGROUND OF THE INVENTION

People enjoying outdoor activities often desire refreshment. In the summer, the usual desire is for something cool to drink. In the spring or fall, a warm beverage or snack may be preferred. It may be that those persons wishing refreshment are a considerable distance from the nearest tea shop or refreshment stand. They may have hiked some distance, or, in the case of golf, have reached a point far out on the course. In such circumstances, it is convenient to be able to take a supply of cooled or heated refreshments along, for use as desired.

On very hot summer days, people engaged in an outdoor activity may often seek to cool themselves in an effort to obtain momentary relief from sweltering heat. In addition to cooled beverages, persons may wish to spray a fine mist on their skin in order to cool down. A desirable cooling effect on the skin is achieved as the droplets of water or other liquid evaporate. In such instances, it is convenient to have a mister, capable of delivering a spray of droplets, that is compact, portable and can be stored easily.

Another related problem, particularly when golfing as a visitor or hiking, is that secure locker facilities may not be available or may be inconveniently distant. It is often uncomfortable to golf or hike with a wallet or set of keys contained in one or another pants pocket. A golfer may wish to keep his or her valuables, such as a wallet and car keys, close at hand during a round of golf, in a container that is within the golfer's view. In recent times, the growing popularity of cellular telephones has made it possible for golfers, hikers, cross country skiers, picnickers or others, to remain in touch with their business colleagues while enjoying their outdoor activities, often so smoothly that others may be scarcely aware that they are not at the office. A cellular telephone is another object that is uncomfortable to carry when golfing or skiing, for example. Cellular telephones are easily stolen and highly marketable. For both convenience of use and discouragement of theft, they should be kept relatively close to the user. At the same time, the ability to carry, for example, extra golf balls, chocolate bars, or gum, and to carry a score card or map in a visible position, with enhanced accessibility are further common needs.

It may be uncomfortable, or cumbersome to have a multiplicity of objects to carry. A number of items may fit within a golf bag, along with various clubs, but the golf bag may not be sufficiently large to carry some items, and some items may risk damage if placed in the golf bag itself. A golf bag is not generally a convenient place to have a cooling medium, such as ice cubes. Further, the prospect of spilling lemonade, carbonated drinks, or beer, however much by accident, inside either the golf bag amongst the woods and irons, or in a pocket of the golf bag, is not one that would be greeted with enthusiasm by many golfers. A segregated auxiliary carrying case that is separately washable, that is mountable to the golf bag, and that can be carried with it, is preferable. It would be even more advantageous to have a pack that can be mounted with the golf bag when the bag is carried on a wheeled carriage or in a golf cart. In this way a golfer's hands are not further encumbered. Moreover, it would be very convenient for such a pack to hold a drink bottle or a mister in a readily accessible position. A golfer could quickly quench his thirst with a refreshing drink from the drink bottle and store it back in the pack easily, away from the golf clubs, for future use. In much the same way, a golfer can keep a mister close at hand, but away from the golf clubs, to enjoy its cooling effects frequently.

SUMMARY OF THE INVENTION

In a first aspect of the invention there is a pack. It has an insulated compartment, an auxiliary compartment mounted next to the insulated compartment and a mount for attaching the pack to another object. The auxiliary compartment has a receptacle of a size for receiving a telephone handset, another receptacle of a size for receiving a wallet, and a closure securable in a closed position to conceal the contents of the receptacles.

In an additional feature of that aspect of the invention, the pack has a breadth corresponding to the thickness of a golf bag. In another additional feature of that aspect of the invention, the pack has a second mount for inhibiting swaying of the pack relative to the other object. In a further additional feature of that aspect of the invention, the pack includes a see-through pocket mounted externally to the auxiliary compartment. The see-through pocket is of a size to receive a golf ball.

In another additional feature of that aspect of the invention, the pack has a leading panel for placement adjacent to the golf bag, a pair of side regions, a trailing region, a bottom and a top. A see-through pocket is mounted to one of the side regions. The see-through pocket has an access lip that has a leading portion and a trailing portion. The leading portion has a greater altitudinal dimension relative to the pocket than the trailing portion.

In a further additional feature of that aspect of the invention, the pack has a lid. The lid has a handle. The handle has a reinforced attachment to the lid, whereby, when closed, the pack can be carried by the handle.

In a still further additional feature of that aspect of the invention, the insulated compartment has a substantially impermeable liner, and the liner can be inverted to facilitate washing. In yet another additional feature, the insulating compartment has a thermal transfer medium holder, and that holder is vented.

In still another further additional feature of that aspect of the invention, the auxiliary compartment includes a key holder. In a still further feature of that additional feature, the key holder includes a lanyard secured within said auxiliary compartment.

In another aspect of the invention, there is an insulated pack. It has an insulated compartment. It has a first mount, for carrying the weight of the pack. The first mount is located on an upper region of the pack and is for attaching the pack to another object. The pack also has a second mount located on a lower region of the pack for attaching to the other object at a different location than the first mount.

In an additional feature of this aspect of the invention, the pack is reinforced at the location at which the first mount is attached to it. In another additional feature of the invention, the pack is reinforced at the location at which the second mount is attached to it. In a further additional feature, the first mount is a quick release hanging mount and the second mount is a cinch strap.

In another additional feature of that aspect of the invention, the pack further comprises a soft shell wall having a leading portion, a trailing portion, a pair of side portions, and a bottom portion. The soft shell wall has an opening in the upper region. The opening has a rim. The pack has a lid for closing the opening, and an upper girth reinforcement for reinforcing said rim. It also has a lower girth reinforcement for reinforcing the lower region. In a further additional feature, the lid has a carrying handle, is moveable to a closed position, and has a securable closure whereby, when closed, the pack can be carried by the handle. In a yet further additional feature of that aspect of the invention, the soft shell wall is an insulating wall and forms the boundary of the insulated compartment. The auxiliary compartment is mounted externally of the soft shell wall.

In a yet further again additional feature of that aspect of the invention, the pack includes a see through pocket located externally on the soft shell wall and has an access opening that is tapered from a tall leading portion to a short trailing portion. In again another additional feature of that aspect of the invention, the soft shell wall is an insulating wall bounding the insulated compartment. The insulated compartment has a substantially impermeable liner mounted to the rim. The liner can be inverted to facilitate washing.

In another aspect of the invention, there is a pack for mounting to a golf bag. It has an insulated compartment and an auxiliary compartment having a closure for concealing the contents thereof It also has a first mount for carrying the vertical load of the pack located on an upper region of the pack for attaching the pack to the golf bag. There is a second mount located on a lower region of the pack for attaching to the golf bag at a different location than the first mount.

In another aspect of the invention there is a cooler. It has a top, a bottom, and a flexible insulated sidewall extending therebetween to define an insulated compartment therewithin. The insulated sidewall has a height and a breadth. The height is greater than the breadth. The insulated sidewall has a first portion and an arcuate second portion attached thereto. The first and second portions define a D-shaped cylinder extending between the bottom and the top. The insulated sidewall has a lower margin mating with the bottom, and an upper margin distant from the bottom. The top is attached to the upper margin. A portion of the top is moveable to an open position to permit objects to be placed in the insulated compartment. A receptacle is mounted to, and stands at least partially outwardly of, the insulated sidewall. The receptacle is accessible from outside the insulated sidewall.

In an additional feature of that aspect of the invention, the receptacle includes an upstanding wall member mounted to the insulated sidewall. The upstanding wall member has an upper region and a lower region. The upper region defines at least a portion of an opening by which objects can be introduced into the receptacle.

In another additional feature of that aspect of the invention, the receptacle has a base having a peripheral edge and the lower region of the insulated sidewall is attached to at least a portion of the peripheral edge of the base.

In a further additional feature of that aspect of the invention, the peripheral edge is arcuate. In a still further additional feature of that aspect of the invention, the receptacle is an open-topped receptacle. The open-topped receptacle has a retaining member for engaging an object introduced therein. In yet a further additional feature of that aspect of the invention, the retaining member is a resilient member mounted in a position to engage an object introduced into the receptacle.

In another additional feature of that aspect of the invention, the receptacle has a top peripheral rim defining an opening in the receptacle, and the resilient member is a resilient band mounted about the top peripheral rim. In still another additional feature of that aspect of the invention, the receptacle has an opening defined therein. The insulated sidewall has a cover member attached thereto. The cover member is moveable to overlie the opening of the receptacle. In a further additional feature of that aspect of the invention, the cover member is a flap. The flap has a closure member to secure the flap to the receptacle thereby restricting access thereto.

In still a further additional feature of that aspect of the invention, the receptacle has a shrouding member mounted externally thereto. In yet a further additional feature of that aspect of the invention, the shrouding member includes a collar and a drawstring operable to urge the collar. In still another additional feature of that aspect of the invention, a portion of the upstanding wall member is a see-through mesh web. In yet another additional feature of that aspect of the invention, the upstanding wall member is insulated.

In another aspect of the invention there is a cooler. It has a top, a bottom, and a flexible insulated sidewall extending therebetween to define an insulated compartment therewithin. The insulated sidewall has a height and a breadth. The height is greater than the breadth. The insulated sidewall has a first portion and an arcuate second portion attached thereto. The first and second portions define a D-shaped cylinder extending between the bottom and the top. The second, arcuate portion has a first side region bordering the first portion, a second, opposed side region bordering the first portion, and a medial region between the first and the second side regions. The medial region is generally opposed to the first portion. The insulated sidewall has a lower margin mating with the bottom, and an upper margin distant from the bottom. The top is attached to the upper margin. A portion of the top is moveable to an open position to permit objects to be placed in the insulated compartment. An open-topped receptacle is mounted to, and stands at least partially outwardly of the insulated sidewall. The receptacle is accessible from outside the insulated sidewall.

In an additional feature of that aspect of the invention, the receptacle is mounted to the first side region of the second, arcuate portion. In another additional feature of that aspect of the invention, a second open-topped receptacle is mounted to the second side region of the second, arcuate portion. In yet another additional feature of that aspect of the invention, an auxiliary enclosure structure is mounted to the medial region of the second, arcuate portion of the insulated sidewall and extends outwardly thereof In still another additional feature of that aspect of the invention, an auxiliary enclosure structure is mounted between the first and the second receptacles.

In a further additional feature of that aspect of the invention, the receptacle has right and left hand side edges extending vertically along the insulated sidewall for mounting the receptacle to the insulated sidewall. A wall structure extends between the side edges. A portion of the wall structure defines a chamber therewithin. The chamber is shaped to receive a cylindrical object therewithin.

In another aspect of the invention there is a cooler. An insulated wall structure has a top, a bottom, and a flexible insulated sidewall extending therebetween to define an insulated compartment therewithin. The insulated sidewall has a height and a breadth. The height is greater than the breadth. The insulated sidewall has a first portion and an arcuate second portion attached thereto. The first and second portions define a D-shaped cylinder extending between the bottom and the top. A portion of the insulated wall structure is moveable to an open position to permit objects to be placed in the insulated compartment. A receptacle is mounted to the insulated sidewall. A vessel for containing liquid is removeably mounted within the receptacle.

In an additional feature of that aspect of the invention, the receptacle stands at least partially outwardly of the insulated sidewall. In another additional feature of that aspect of the invention, the receptacle has a chamber defined therein. The chamber is accessible from outside the insulated sidewall. In still another additional feature of that aspect of the invention, the chamber has an impermeable liner mounted therewithin.

In yet another additional feature of that aspect of the invention, the receptacle includes a thermally insulative layer for discouraging heat transfer through the receptacle. In a further additional feature of that aspect of the invention, the receptacle has a wall structure and the wall structure has a peripheral rim thereabout. A portion of the peripheral rim defines an opening within the receptacle. At least a portion of the vessel outwardly protrudes from the opening. In still a further additional feature of that aspect of the invention, the receptacle has a member located to shelter the vessel.

In another additional feature of that aspect of the invention, the member is a shroud member. The shroud member has a collar and a drawstring operable to urge the collar to engage at least a portion of the vessel protruding outwardly from the receptacle. In still another additional feature of that aspect of the invention, a shading member covers the vessel. In yet another additional feature of that aspect of the invention, the vessel is a vessel selected from the group consisting of a drink bottle and a mister.

In another aspect of the invention there is a cooler. The cooler has an insulated wall structure having a top, a bottom, and a flexible insulated sidewall extending therebetween to define an insulated compartment therewithin. The insulated sidewall has a height and a breadth. The height is greater than the breadth. The insulated sidewall has a first portion and an arcuate second portion attached thereto. The first and second portions define a D-shaped cylinder extending between the bottom and the top. A portion of the insulated wall structure is moveable to an open position to permit objects to be placed in the insulated compartment. A receptacle is mounted to the insulated sidewall. A mister is removeably mounted within the receptacle and has a liquid reservoir. It has a pressurization apparatus removeably mounted to the reservoir, a spray nozzle in fluid communication with the reservoir and a valve operable to control the flow of liquid to the spray nozzle.

In a still further additional feature of that aspect of the invention, the pressurization apparatus includes a manual air pump. In still another further additional feature of that aspect of the invention, the receptacle has a thermally insulative layer for discouraging heat transfer through the receptacle. In another additional feature of that aspect of the invention, a second receptacle is mounted to the insulated sidewall. A second vessel for containing liquid is removeably mounted within the second receptacle.

In still another additional feature of that aspect of the invention, the second receptacle stands at least partially outwardly of the insulated sidewall. In yet another additional feature of that aspect of the invention, the first and the second receptacles are mounted to the second, arcuate portion of the insulated sidewall in a saddle bag arrangement. In a further additional feature of that aspect of the invention, the first vessel is a drink bottle and the second vessel is a mister.

DETAILED DESCRIPTION OF THE INVENTION

Figure 1:
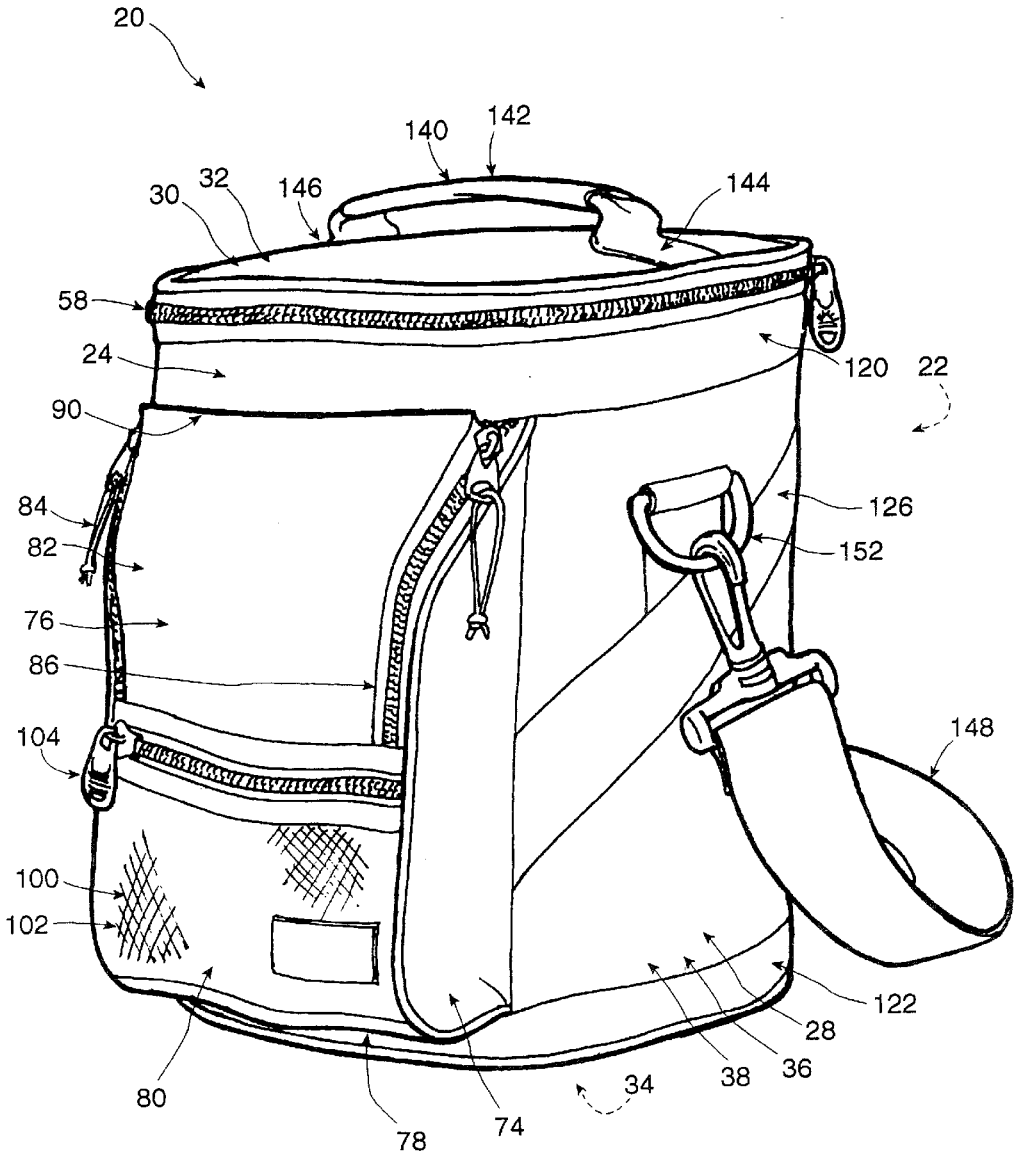
FIG. 1 is a general arrangement three quarter view of an example of a pack according to the principles of the present invention.

The description which follows, and the embodiments described therein, are provided by way of illustration of an example, or examples of particular embodiments of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention.

Figure 2:
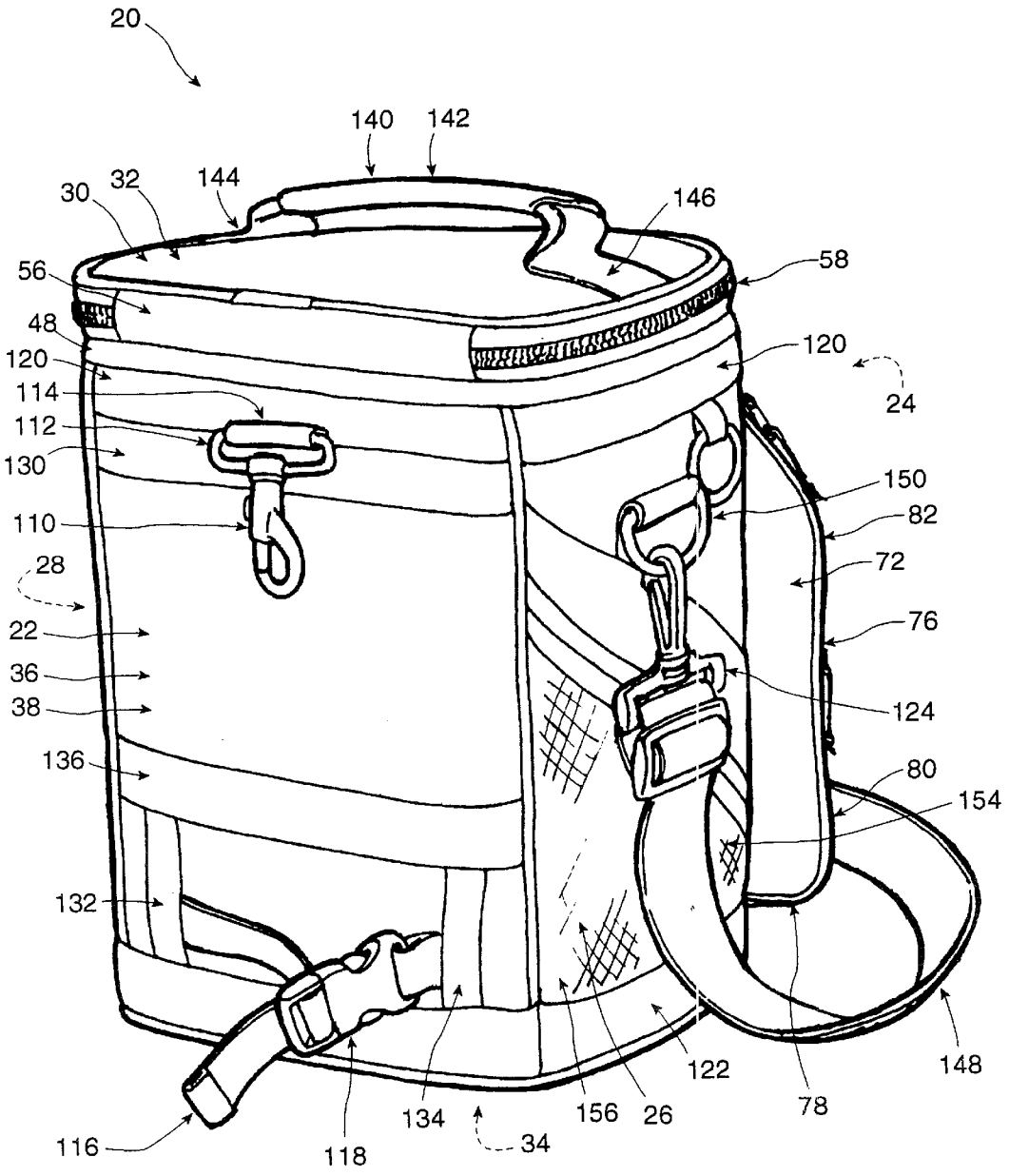
FIG. 2 is a view of the example of FIG. 1 taken on the opposite quarter of the same side, and from above, with a lid of the pack in an open position.
Figure 3:
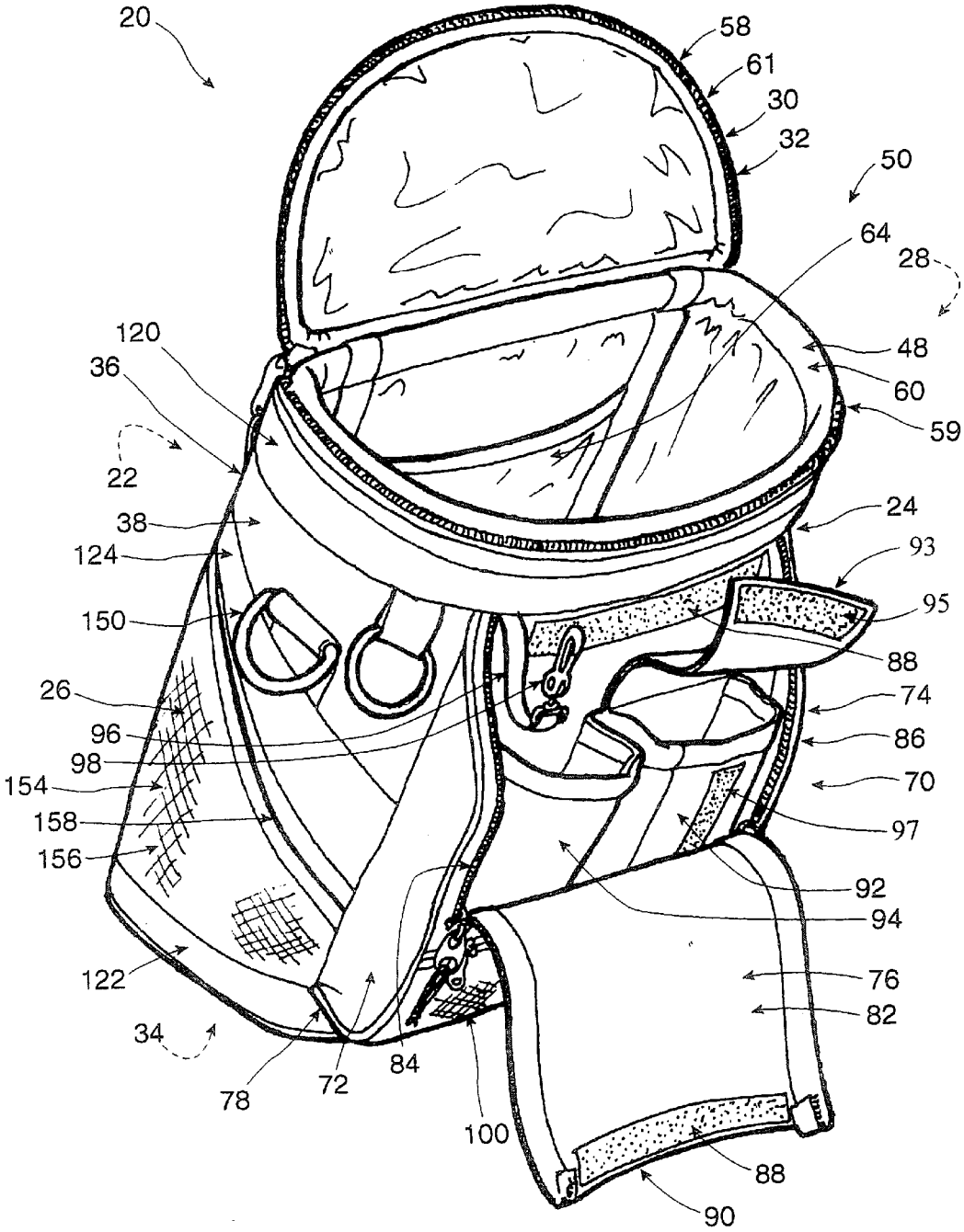
FIG. 3 is the opposite three quarter view to the view of FIG. 1.
Figure 7:
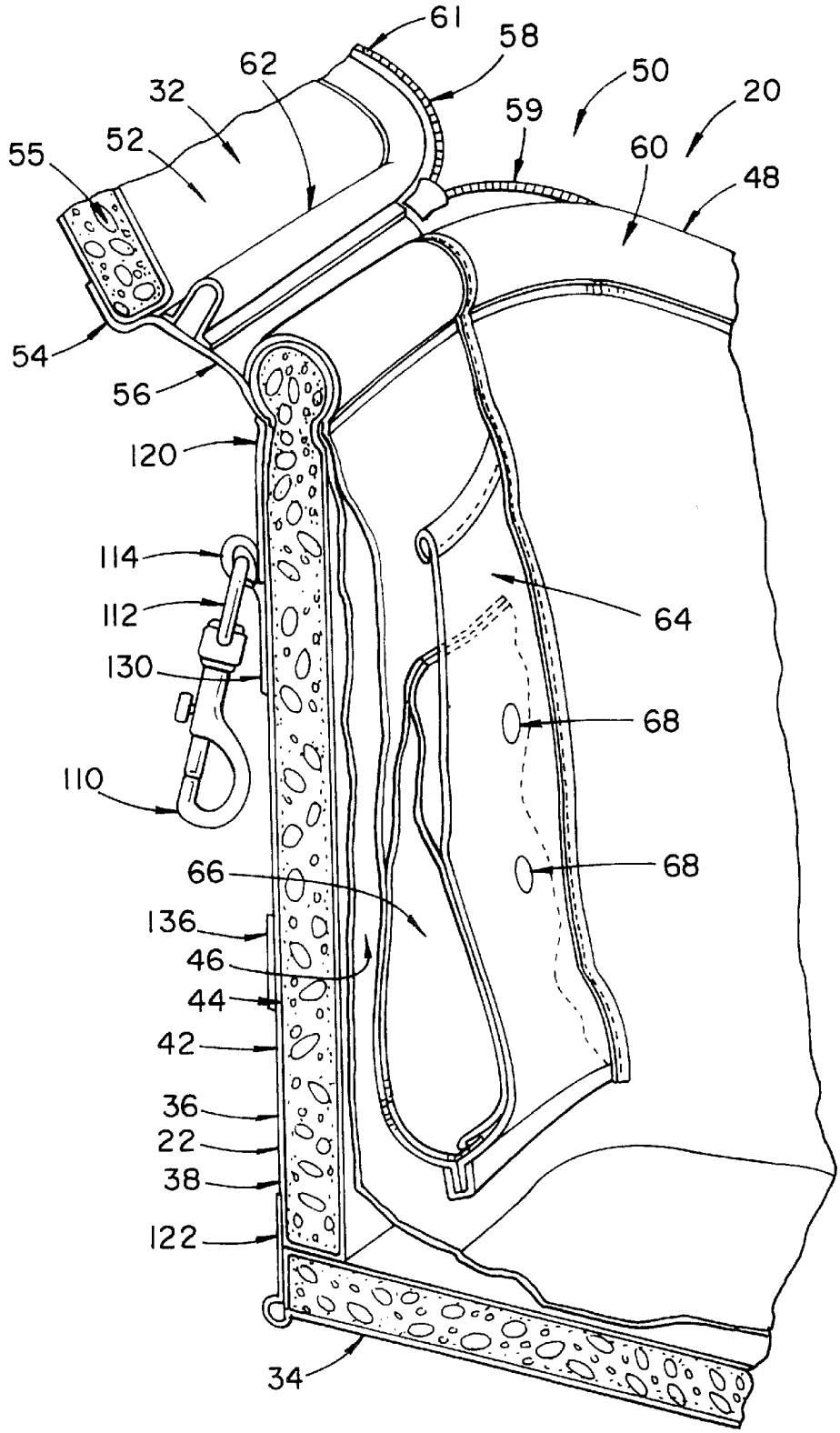
FIG. 7 shows a scab section of the pack of FIG. 1 showing a detail of a coolant pouch and a detail of the wall construction of the pack.

Referring to FIGS. 1, 2, and 3, an insulated pack having a shape that is generally similar to a golf bag, but on a smaller scale, is shown generally as 20. It has a leading portion 22, a trailing portion 24, a pair of left and right hand side portions 26 and 28, a top portion 30 having a lid 32, and a bottom portion 34. The major part of pack 20 is an insulated compartment 36 bounded by a modestly flexible soft shell insulating wall, 38, whose construction is shown in FIG. 7. The breadth of pack 20, that is, the overall width when viewed from the leading or trailing directions, is about 8½" empty. When undeformed, pack 20 has a gently bulging D-shaped cross section when seen from above, similar to a golf bag, although this may change somewhat when loaded. The breadth is roughly the same as the thickness of a middling to large size of golf bag. Referring briefly to the detail of FIG. 7, wall 38 has an outer covering 42 of webbed construction, and an internal closed cell foam layer 44 within covering 42.

Further, liner 46 is not, in the example illustrated, fixed to the bottom of compartment 36, but can be pulled out of compartment 36 to an inverted position (while still remaining attached at rim 48) to facilitate washing with soap, and to facilitate drying, to discourage the grow of fungus and so on. Liner 46 has a single circumferential seam to join a bottom face, and a single wall seam running from the circumferential bottom seam to rim 48. In an optional alternative, liner 46 could be made from a polymer that has been impregnated with an antimicrobial compound prior to fabrication, a desirable feature for this kind of liner.

The top of compartment 36 is formed by a generally D-shaped lid 32. Lid 32 also has a through section structure of a flexible reflective inner layer 52, a flexible skin in the nature of a canvas or webbing covering 54, and a flexible closed cell insulation layer 55, (similar to layer 44, above) captured in between. Lid 32 is joined to the main body of pack 20, along the roughly straight side of the 'D' shape, by a hinge in the nature of a flexible fabric hinge 56, and a peripheral tracked closure in the nature of a zipper 58 having a pair of opposed zipper cars.

Rim 48 has a resiliently spongy beaded lip 60 wrapped within the upper edge of liner 46, adjacent to the set of zipper teeth 59 of zipper 58 that is mounted to the main body of pack 22. Lid 32 has a mating, generally D-shaped, peripheral lip 62 immediately next to the set of zipper teeth 61 of zipper 58 mounted to lid 32. When zipper 58 is closed, lip 62 is drawn down to bear on the outside surface of beaded lip 60, encouraging a sealing contact to be formed.

Within main compartment 36 a thermal transfer storage medium compartment is provided against a leading wall portion of insulating wall 38 by the use of a sack 64 for holding the thermal storage medium 66. Thermal storage medium 66 may be used as a source of heat to be transferred into the contents of compartment 36, that is, to maintain a warm temperature distribution in compartment 36. Alternatively, the thermal storage medium 66 can be used as a heat sink to maintain a cool, chilled, or freezing temperature distribution in the contents of compartment 36, as circumstances may require. Sack 64 has an array of perforations 68 to allow air to circulate through sack 64 more easily, facilitating drying of sack 64 after washing.

The second major component of insulated pack 20 is an auxiliary compartment in the nature of a valuables compartment 70, that is mounted to trailing portion 24, externally of soft shelled insulating wall 38. Compartment 70 has a pair of left and right hand side portions 72 and 74 that are connected to, and extend vertically along, and rearwardly from the trailing portion of insulating wall 38; and a single piece trailing wall 76 extending between the distal extremities of side portions 72 and 74. In the preferred embodiment wall 76 is, like the rest of cover 42, made of a 600 denier polyester fabric, treated, as are all external surfaces of pack 20, to be stain and water resistant. Other wall fabrics can be used, such as leather or leather-like vinyl.

Wall 76 has a lower or underside area 78 that meets, and is joined to, the trailing portion of insulating wall 38. Underside area 78 forms the bottom of compartment 70. Wall 76 also has a medial, outer area 80 that extends roughly ⅖ of the way up compartment 70. An upper area 82 of wall 76, in the nature of a flap, is contiguous with outer area 80 on one edge, and has closures on the remainder of its periphery. Two of those closures are left and right hand vertical zippers, 84 and 86, that join with the uppermost parts of the distal edges of side portions 72 and 74. The third is a hook and eye fabric closure 88 for releasably attaching end lip 90 of wall 76 to insulated wall 38 just below rim 48.

Referring to FIG. 3, in which closures 84, 86 and 88 are undone, and upper area 82 lies open, a first receptacle, in the nature of a soft sided, durable fabric pocket 92 with a covering flap 93 has a horizontal hook and eye fastener part 95 mounted on its underside just inside its lip, for mating with a vertically aligned mating hook and eye fabric fastener part 97, the combination of orientations providing an adjustable size, and flexibility in closure position. Pocket 92 is of a size for carrying a cellular telephone handset, having a girth of roughly 5½" (roughly 1¼" deep sides and 3" breadth) and a depth of 6½" from bottom to lip. The interior of pocket 92 is lined with a cushioning material. Pocket 92 can be used for other objects than cellular telephones such as for sunglasses, a glasses case, or other item.

An adjacent receptacle in the nature of a soft-sided, open top pocket 94, without cover, has a convenient size (roughly 4½" girth, 5½" depth) for holding a deodorant container, or other object of similar size. It can, for example, be used as a storage space for a carrying strap. Adjacent to pocket 94 is a key holder in the nature of a lanyard 96 having one end fastened within compartment 70 just below rim 48. At its other, depending end, lanyard 96 has a quick-release spring clip 98 for hooking about the ring of a key chain. Use of a strap, such as lanyard 96, makes it easy to retrieve keys, rather than having to fish around the bottom of compartment 70. The remaining enclosed space within medial outer area 80 and above underside area 78 has a height of roughly 4 inches, and a width of roughly 7 inches between the piping along the outer edges of side portions 72 and 74, leaving space for a wallet, or other items.

Other arrangements of closures are possible for auxiliary compartment 70. A single three sided zipper closure, with one or two zipper cars could be used, and the hook and eye fastener eliminated. Other kinds of fasteners, such as laces and grommets, interference fit seals, snaps, buttons, and so on are possible. The present arrangement is preferred. Similarly, other arrangements of receptacles and key holders, or like items can be used, although the present configuration is convenient, and preferred.

A vented, see-through pocket 100 is mounted externally to medial outer area 80, and is of a size for accommodating, for example, extra golf balls, gum, candy bars or other items. The open form mesh 102 permits objects in pocket 100 to dry more easily. Pocket 100 is closed by a sliding closure in the form of zipper 104.

A main attachment, suitable, for example, for hanging pack 20 from a golf bag, or for clipping pack 20 to a golf bag or golf cart, is shown as a quick release brass hook fitting 110 is mounted to an upper region of pack 20 on leading portion 22. Hook fitting 110 is free to revolve within its hinge fitting, 112, which itself is able to swing up and down within the confines of a broad loop of webbing 114.

A second attachment, suitable for tightening to another fastening location of a golf bag or golf cart, in the nature of an adjustable cinch strap 116 is mounted to a lower region of pack 20, also on leading portion 22. Strap 116 has a releasable catch 118, and can be used to tighten the lower region of pack 20 to a golf bag, golf cart, or other object, to restrain its swaying motion about the main attachment at hook fitting 110.

It is anticipated that a significant use of main insulated compartment 36 will be for carrying cans of liquid, such as carbonated beverages, fruit drinks, or beer, whether or not accompanied by ice cubes or crushed ice. Inasmuch as the preferred embodiment illustrated has a capacity of 12 cans of 385 ml plus ice, a load of 10 to 12 Lbs. (50 to 55 N) would not be unexpected. The height of the preferred embodiment illustrated to the lip of rim 48 is roughly 12 inches. Liner 46 is not taut when lying against the inner walls of compartment 36. That is, liner 46 has some slack, and is somewhat elastic in any event. Consequently load is taken up primarily, if not entirely, in soft shelled insulating wall 38, and more specifically, principally in outer covering 42 of wall 38.

The main attachment at hook fitting 110 is able to carry the entire weight of pack 20, and the second attachment, at cinch strap 116, inhibits swaying of pack 20 about the first attachment. Outer covering 42 has an upper reinforcing band 120 extending externally about the periphery of insulating wall 38 next to rim 48. A lower reinforcing band 122 extends externally about the bottom edge of pack 20 where leading portion 22, trailing portion 24, and side portions 26 and 28 meet bottom portion 34, that is to say, about the lower region of pack 20.

A pair of left and right hand web doublers, 124 and 126 commence at a relatively high location at the leading edges of respective side portions 26 and 28, extend across the surface of those sides, and terminate at a lower location on the trailing edge of side portions 26 and 28. That is, they extend from the leading edge of the upper region, to the trailing edge of a lower region of pack 20.

The attachment of hook fitting 110 to pack 20 is reinforced by an upper lateral reinforcing band 130, in addition to upper reinforcing band 120, the effect being to spread the stress concentration out. Lateral reinforcing band 130 ends at the leading edges of side portions 26 and 28, close to the leading ends of doublers 124 and 126, yielding a reinforced load path between the lower region of pack 20 and hook fitting 110.

Similarly, each end of cinch strap 116 is sewn under a vertical left or right hand root reinforcement 132 or 134, each of these in turn leading to either lower reinforcing band 122 or a lower lateral reinforcement band 136, whose ends reach to the leading edges of side portions 26 and 28.

For ease and comfort of carrying pack 20 by hand, lid 32 is provided with a carrying handle 140 having a padded bail 142, and a pair of webbing feet 144 and 146 that extend fully to opposite points on the periphery of lid 32, such that loads carried through handle 140 are transmitted not only through the outer covering layer of lid 32 but also through the reinforcement of feet 144 and 146. At the edge of lid 32, the presence of upper reinforcing band 120 helps to spread the load more evenly to, and from, the vertical sidewalls formed by portions 22, 24, 26, and 28. Alternatively, pack 20 can be carried by a shoulder strap 148 fastened by spring clips to D-shaped rings 150 and 152, mounted on either of sides 26 and 28.

Left hand side portion 26 is provided with a trapezoidally shaped external pocket 154 having a breathing, see-through mesh 156 similar to mesh 102. A scorecard, or map, placed in this pocket can be seen for retrieval. Lip 158 of pocket 154 is set on a rake angle, yielding a somewhat larger opening for sliding a scorecard in, without having as carefully to fit it into a narrow opening as might otherwise be the case for a square cut pocket.

Figure 4:
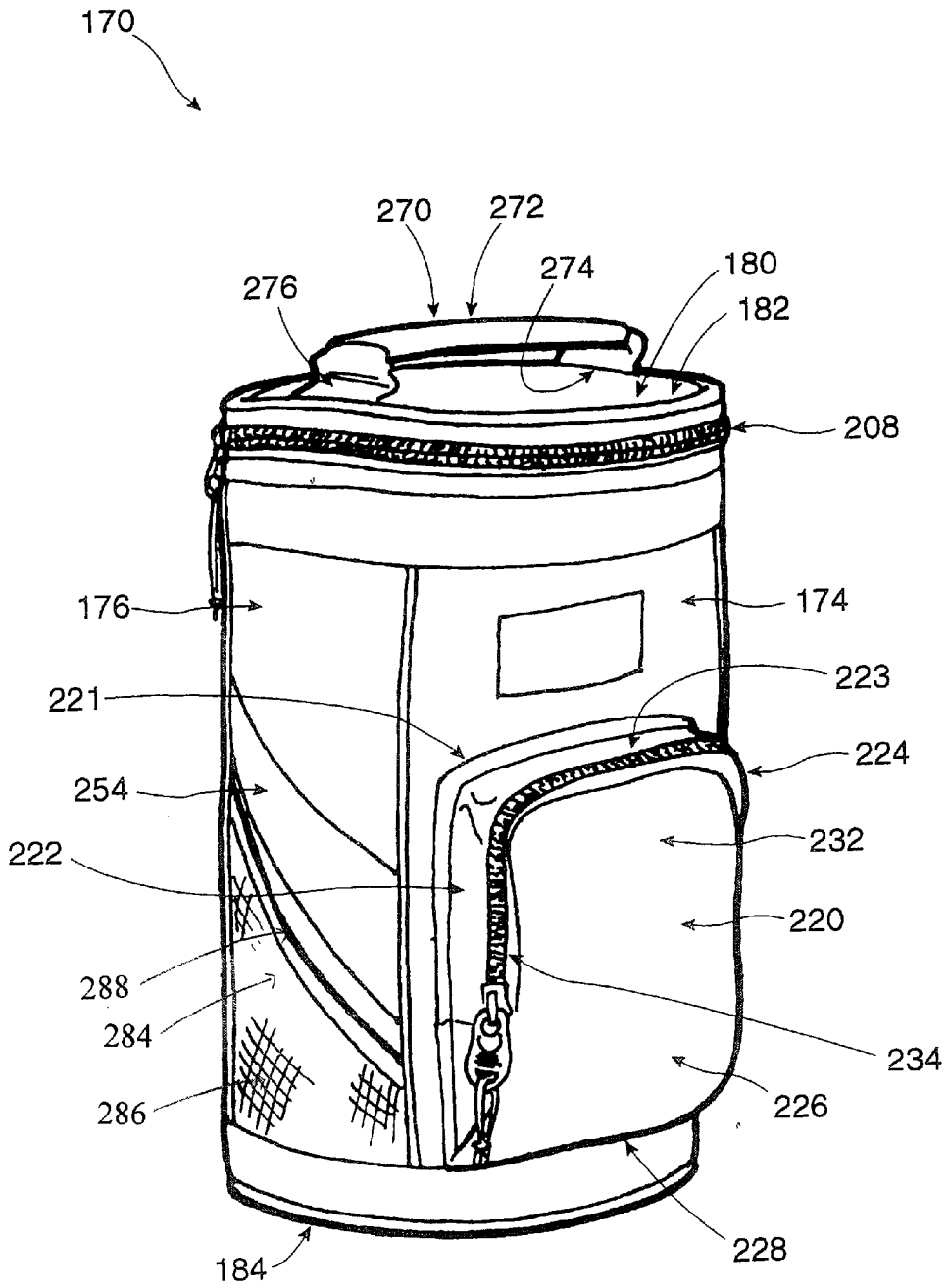
FIG. 4 is a three quarter view taken rearwardly and to the side of another pack according to the principles of the present invention.
Figure 5:
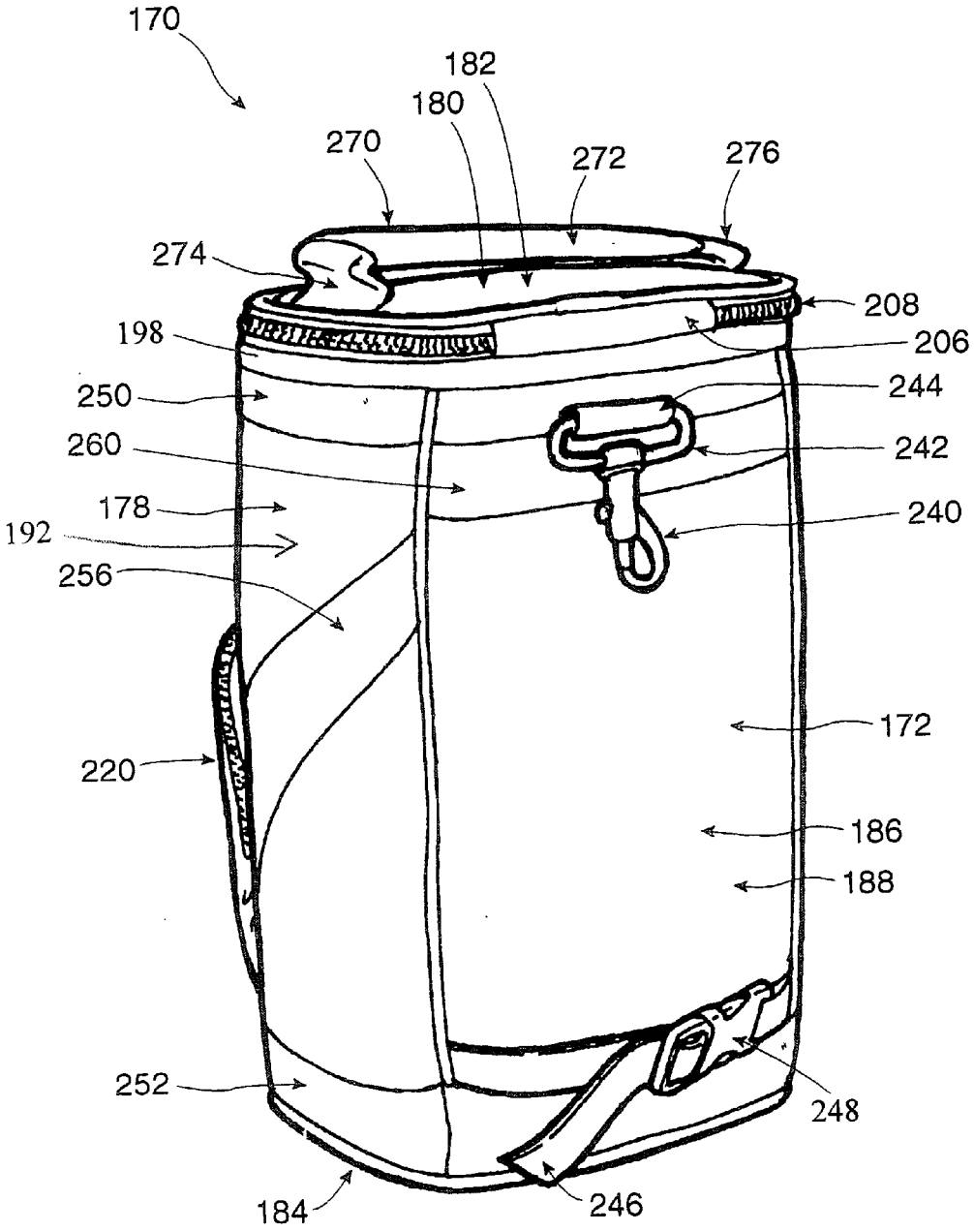
FIG. 5 shows the opposite three quarter view of the pack of FIG. 4.
Figure 6:
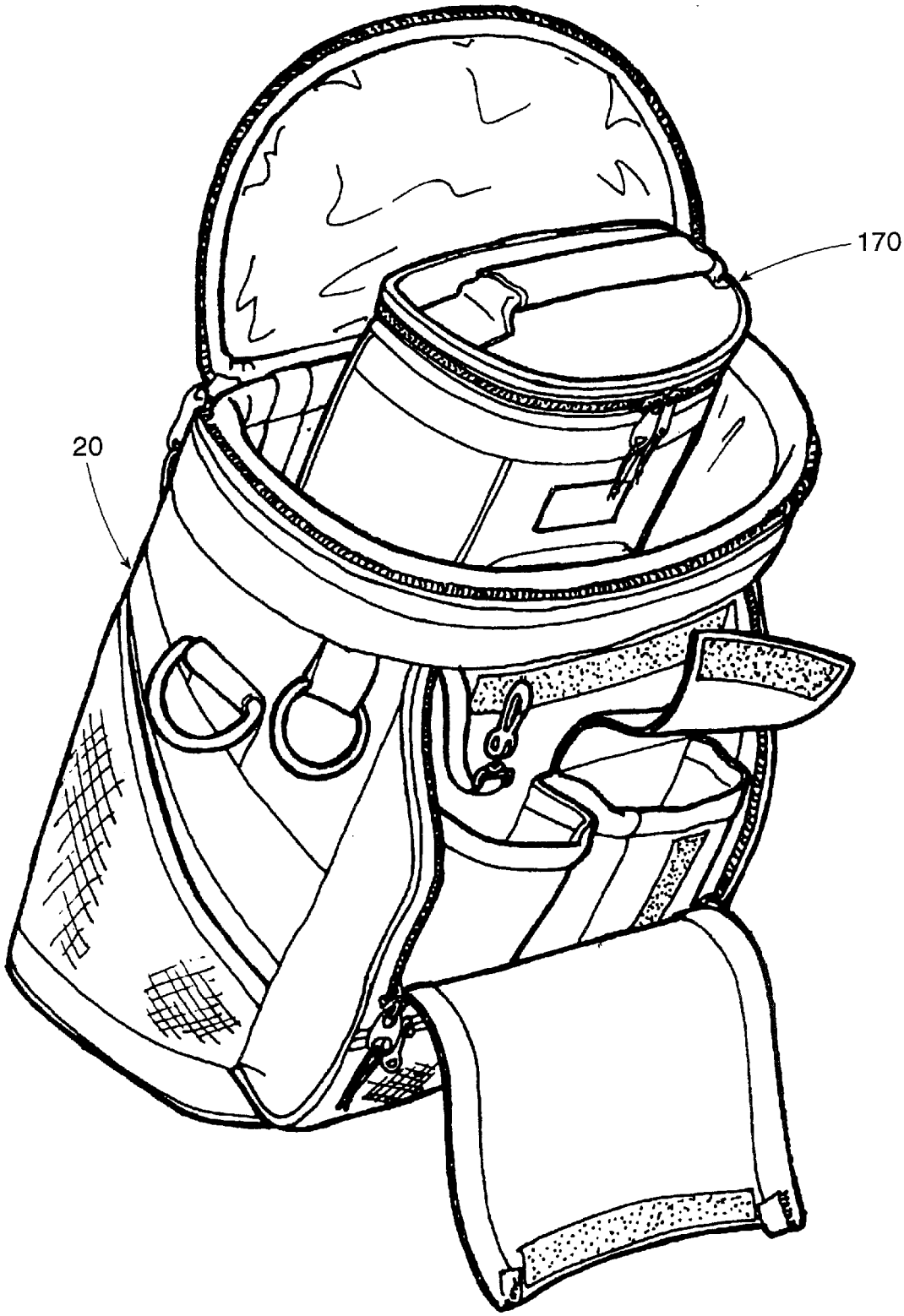
FIG. 6 shows a top view of the pack of FIG. 2, in an open state, with the pack of FIG. 4 partially nested therein.

Referring to FIGS. 4 and 5, a second insulated pack, is shown generally as 170. In this embodiment, pack 170 is of a size for carrying 5 cans. It has a leading portion 172, a trailing portion 174, a pair of left and right hand side portions 176 and 178, a top portion 180 having a lid 182, and a bottom portion 184. The major part of pack 170 is an insulated compartment 186 bounded by a modestly flexible soft shell insulating wall 188, whose wall construction is the same as that shown in FIG. 7 and discussed above. The breadth of pack 170, that is, the overall width when viewed from the leading or trailing directions, is about 6½" empty. When undeformed pack 170 has a gently bulging D-shaped cross section when seen from above again, not dissimilar in general appearance to a golf bag. The breadth is roughly the same as the thickness of a small size of golf bag, and, is such that pack 170 can nest comfortably in compartment 36 of pack 20. This is shown in FIG. 6.

The top of compartment 186 is formed by generally D-shaped lid 182. Lid 182 has the same layered construction as lid 32. Lid 182 is joined to the main body of pack 170, along the roughly straight side of the 'D' shape, by a hinge in the nature of a flexible fabric hinge 206, and a peripheral tracked closure in the nature of a zipper 208 having a pair of opposed zipper cars. The manner of closing lid 182 on compartment 186 of pack 170 is the same as for lid 36 of pack 20. Further, the same kind of substantially impermeable liner and thermal storage medium are used. The thermal storage medium is held in a sack similar to sack 64.

The second major component of insulated pack 170 is an auxiliary compartment in the nature of a valuables compartment 220, that is mounted to trailing portion 174, externally of soft shelled insulating wall 188. Compartment 220 has a generally downwardly opening, U-shaped member 221 that has pair of left and right hand side portions 222 and 224 that are connected to, and extend vertically along, and rearwardly from the trailing portion of insulating wall 188 and a top cross portion 223 extending between them. Compartment 220 also has a single piece trailing wall 226 extending between the distal extremities of side portions 222 and 224. Wall 226 is made of canvas. Wall 226 has a lower or underside area 228, that meets and is joined to the trailing portion of insulating wall 188. Underside area 228 forms the bottom and lower trailing face of compartment 220. Wall 226 also has an upper area 232, being a flap contiguous with underside area 228 on one edge. Upper area 232 has a three sided wrap-around closure, being a zipper 234 that joins the corresponding edge of U-shaped member 221. As described above in the context of pack 20, compartment 220 has internal receptacles lined with cushioning for receiving valuables, glasses, keys, and so on.

A main attachment, suitable, for example, for hanging pack 170 from a golf bag, or for clipping pack 170 to a golf bag or golf cart, is shown as a quick release brass hook fitting 240, mounted to an upper region of pack 170 on leading portion 172. Hook fitting 240 is free to revolve within its hinge fitting, 242, which itself is able to swing up and down within the confines of a broad loop of webbing 244.

A second attachment, suitable for tightening to another fastening location of a golf bag or golf cart, in the nature of an adjustable cinch strap 246 is mounted to a lower region of pack 170, also on leading portion 172, but in this case being rooted at the outside edges of leading portion 172 where they meet the leading edges of side portions 176 and 178. Strap 246 has a releasable catch 248, and can be used to tighten the lower region of pack 170 to a golf bag, golf cart, or other object, to restrain its swaying motion about the main attachment at hook fitting 240.

Outer covering 192 has an upper reinforcing band 250 extending externally about the periphery of insulating wall 188 next to rim 198. A lower reinforcing band 252 extends externally about the bottom edge of pack 170 where leading portion 172, trailing portion 174, and side portions 176 and 178 meet bottom portion 184, that is to say, about the lower region of pack 170.

A pair of left and right hand doublers, 254 and 256 commence at a relatively high location at the leading edges of respective side portions 176 and 178, extend across the surface of those sides, and terminate at a lower location on the trailing edge of side portions 176 and 178.

The attachment of hook fitting 240 to pack 170 is reinforced by an upper lateral reinforcing band 260, in addition to upper reinforcing band 250, the effect being to spread the load out. Lateral reinforcing band 260 ends at the leading edges of side portions 176 and 178, close to the leading ends of doublers 254 and 256, yielding a reinforced load path between the lower region of pack 170 and hook fitting 240.

Lid 182 is provided with a carrying handle 270 having a padded bail 272, and a pair of webbing feet 274 and 276 that extend fully to opposite points on the periphery of lid 182, such that loads carried through handle 270 are transmitted not only through the outer covering layer of lid 182 but also through the reinforcement of feet 274 and 276. At the edge of lid 182 the presence of upper reinforcing band 250 helps to spread the load more evenly to and from the vertical sidewalls formed by portions 172, 174, 176, and 178.

Left hand side portion 176 is provided with a trapezoidally shaped external pocket 284 having a breathing, see-through mesh 286 similar to mesh 102. Lip 288 of pocket 284 is set on a rake angle.

Figure 8:
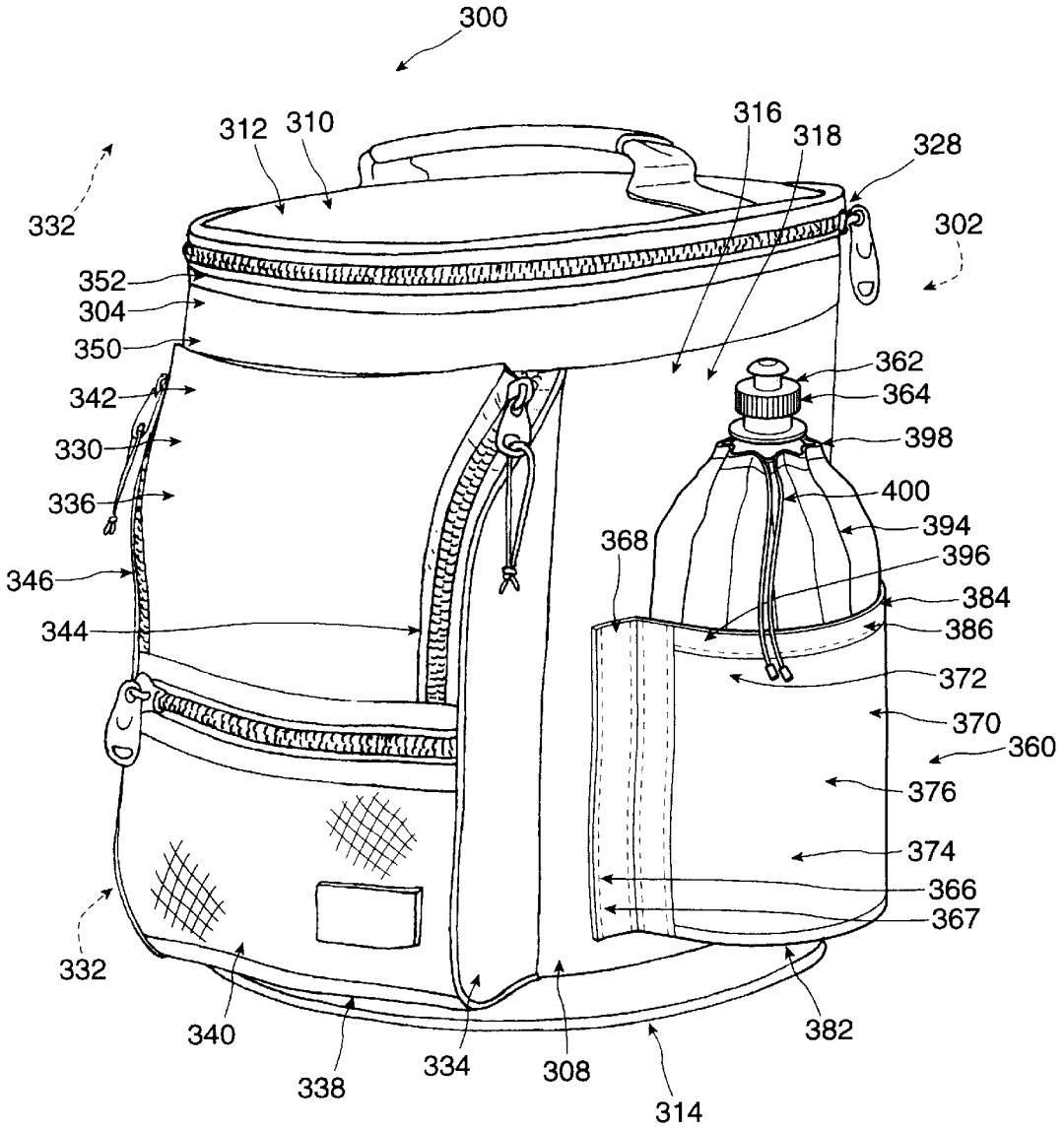
FIG. 8 shows a general arrangement three quarter view of an alternate pack to that FIG. 1.

Referring to FIG. 8, a third insulated pack, is indicated generally as 300. Insulated pack 300 is of generally similar construction to pack 20. It has a leading portion 302, a trailing portion 304, a pair of left and right hand side portions 306 and 308, a top 310 having a lid 312, and a bottom 314. The major part of pack 300 is an insulated compartment 316 bounded by a modestly flexible soft shell insulating wall 318, whose wall construction is the same as shown in FIG. 7 and discussed above. The breadth of pack 300, that is, the overall width when viewed from the leading or trailing directions, is about 8½" empty. When undeformed pack 300 has a gently bulging D-shaped cross section when seen from above again, not dissimilar in appearance to a golf bag.

The top of compartment 316 is formed by a generally D-shaped lid 312. Lid 312 has the same layered construction as lid 32. Lid 312 is joined to the main body of pack 300, along the roughly straight side of the 'D' shape, by a hinge in the nature of a flexible fabric hinge (not shown), and a peripheral tracked closure in the nature of a zipper 328 having a pair of opposed zipper cars. The manner of closing lid 312 on compartment 316 of pack 300 is the same as for lid 32 of pack 20. Further the same kind of substantially impermeable liner and thermal storage medium are used. The thermal storage medium is held in a sack similar to sack 64.

The second major component of insulated pack 300 is an auxiliary compartment in the nature of a valuables compartment 330, that is mounted to trailing portion 304, externally of soft shelled insulating wall 318. Compartment 330 is of similar construction to compartment 70 of pack 20. It has a pair of left and right hand side portions 332 and 334 that are connected to and extend vertically along, and rearwardly from the trailing portion of insulating wall 318. Compartment 330 also has a single piece trailing wall 336 extending between the distal extremities of side portions 332 and 334. Trailing wall 336 is made of canvas. Trailing wall 336 has a lower or underside area 338 that meets, and is joined to, the trailing portion of insulating wall 318. Underside area 338 forms the bottom of compartment 330. Trailing wall 336 also has a medial, outer area 340 that extends roughly ⅖ of the way up compartment 330. An upper area 342 of trailing wall 336, in the nature of a flap, is contiguous with outer area 340 on one edge, and has closures on the remainder of its periphery. Two of those closures are left and right hand vertical zippers, 344 and 346, that join with the uppermost parts of the distal edges of side portions 332 and 334. The third is a hook and eye fabric closure (similar to hook and eye fabric closure 88 of pack 20) for releasably attaching end lip 350 of trailing wall 336 to the insulated wall 318 just below rim 320. Compartment 330 has the same internal receptacles for receiving valuables and other items, as compartment 70 of pack 20, as described above.

Insulated pack 300 also has an externally accessible receptacle 360 for seating a liquid containing vessel 362 such as bottle, can or carton. Receptacle 360 is mounted externally to soft shelled insulating wall 318 and stands arcuately outward on one of side portions 306 or 308 to define a cavity 361 into which a vessel 362 such as, for example, a drink bottle 364 can be placed. Receptacle 360 has a pair of spaced apart, vertical margins 366 for attaching receptacle 360 to insulating wall 318. Each margin 366 has a proximate end 367 and a distal end 368, relative to bottom 314 of pack 300. Stitching between the ends 367 and 368 secures margins 366 to insulating wall 318.

Upstanding wall member 370 extends between margins 366. It has an upper region 372, a lower region 374 and a medial wall 376 extending between regions 372 and 374. Lower region 374 has a base 380 upon which drink bottle 364 can rest when it is seated within receptacle 360. Base 380 has a generally arcuate edge 382 which extends about its periphery. Base 380 is connected to medial wall 376 along edge 382. As can be seen in FIG. 8, base 380 is carried at a location higher than bottom 314 of insulated pack 300.

Rim 384 is formed by top edge 386 of upper region 372. Rim 384 defines an opening 388 which gives access to a chamber 390 defined within receptacle 360. Drink bottle 364 is mounted within chamber 390 in an upright position. The height of receptacle 360 is less than the total height of drink bottle 364 such that drink bottle 364 protrudes from receptacle 360 through opening 388. This facilitates digital access to drink bottle 364. That is, a user can grasp and remove drink bottle 364 from out of receptacle 360 when desired. A liner 392 mounted within chamber 390 discourages leakage of liquid from drink bottle 364 through the walls of receptacle 360. Receptacle 360 is also provided with a thermally insulative layer 393 to discourage heat transfer from the articles held therein to the exterior surroundings.

A covering or sheltering member in the nature of a skirt, or boot, or shroud 394 extends from within chamber 390 outwardly of opening 388 to provide at least partial shade the portion of drink bottle 364 which protrudes from opening 388. The periphery of the lowermost extremity, indicated as hem, or cuff, 396 is stitched to the interior of rim 384. The periphery of the uppermost edge, being a neck or waist, and indicated as collar 398 is folded over to accommodate a drawstring 400. Drawstring 400 can be used to draw collar 398 tightly about drink bottle 364. Shading drink bottle 364 in this manner tends to keep the contents of drink bottle 364 relatively cool.

Figure 9:
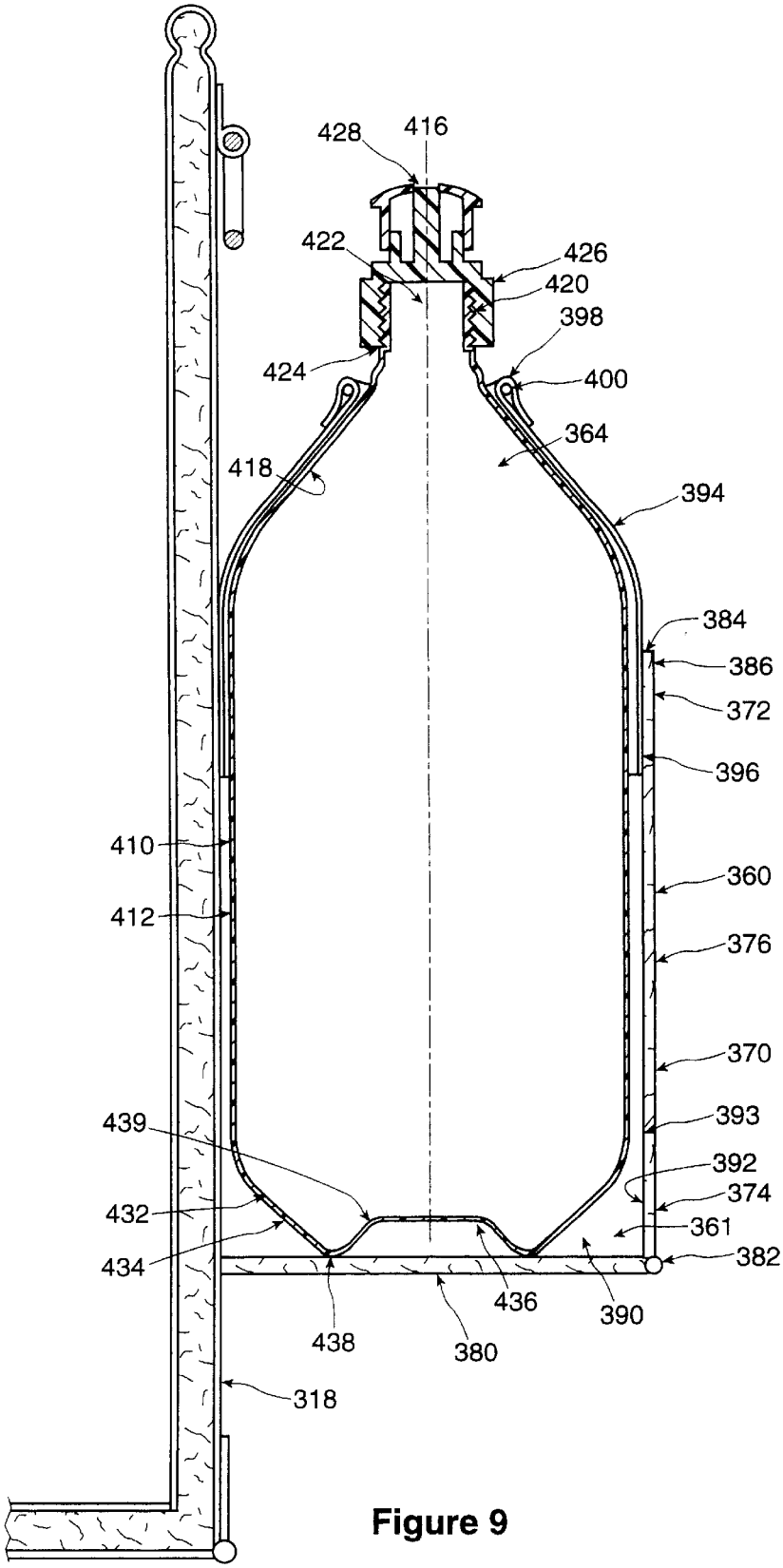
FIG. 9 is a partial cross-sectional view of FIG. 8 taken on section '9—9' showing a detail of a drink bottle seated within a receptacle mounted on the pack.

Turning now to drink bottle 364, it has a major portion 410 in the form of a right cylinder 412, as shown in FIG. 9. Drink bottle 364 has a longitudinal axis 416 that is coincident with the centerline of the round cylindrical section of major portion 410. At one end of drink bottle 364, there is a transition section 418 from the broad profile of major portion 410 to an externally threaded spout or neck 420 which terminates in an outlet 422. An internally threaded nozzle 424 mates with neck 420 and controls the flow of liquid out of drink bottle 364 through outlet 422 of neck 420. Nozzle 424 has a longitudinally translating cap 426 which can be moved to a closed position, in which cap 426 seals nozzle 424, and to an open position, in which a stream of liquid can escape through an end aperture 428. A transparent snap-fit dust cover can be provided.

Drink bottle 364 is soft enough to be squeezed by a person of modest strength with one hand. Adequately forceful squeezing, with drink bottle 364 oriented to place liquid against nozzle 424, will cause a stream to exit drink bottle 364, such that a person can squirt for example, cool water into their mouth without touching the drink bottle other than with the squeezing hand.

At the other, opposite, end of drink bottle 364, there is a bottom end 432 having a taper or chamfer 434, and an end face 436 that has an annular footing 438 and a relieved center 439. When drink bottle is seated in receptacle 360, annular footing 438 rests on base 380.

Other arrangements are possible in which drink bottle 364 is not a body of revolution, and in which the longitudinal axis is not an axis of symmetry of the drink bottle. In general however, the longitudinal axis is oriented perpendicularly to a resting surface when the drink bottle is left sitting on end.

Drink bottle 364 has a round cylindrical section. The section need not be circular, but could be oval, elliptical or square, rectangular, kidney shaped, or some other polygonal or curved shape suitable for containing a liquid. Drink bottle 364 need not have an axis of symmetry, and need not have a spout having a centreline perpendicular to the base on which the drink bottle sits in an upright orientation. The spout, or neck, 420, need not be concentric with the cylindrical form of the drink bottle generally, but could be offset to one side, and could be bent, or mitred, or canted. Other types of spout or nozzle can be used.

Figure 10:
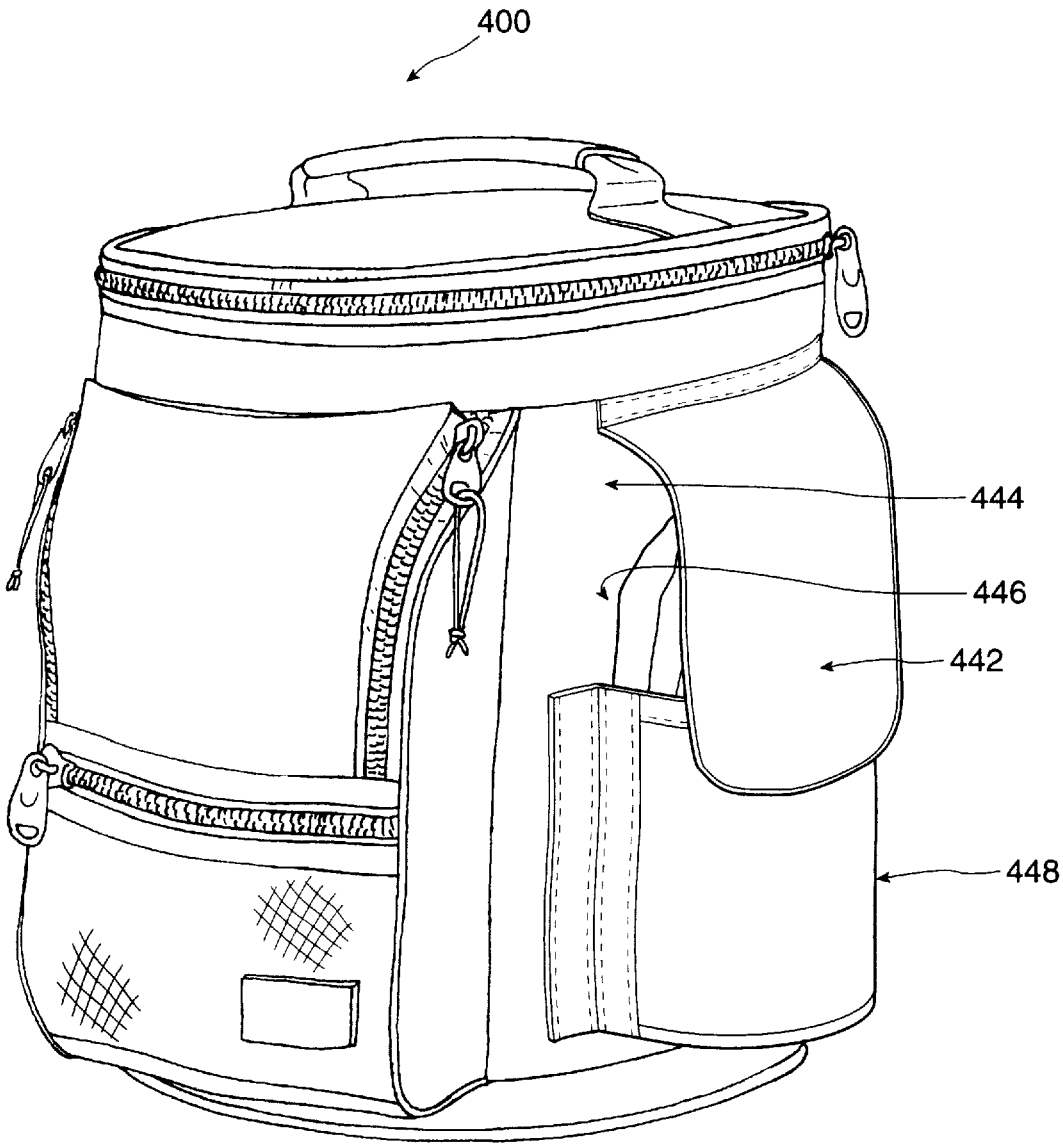
FIG. 10 is an alternative embodiment to the pack of FIG. 8.

It is also possible to have a receptacle that has no shroud. In such a case, a different kind of covering to shade the drink bottle may be provided. Referring to FIG. 10, a cover in the nature of a flap 442 depends downwardly from insulating wall 444 of insulated pack 440 to cover drink bottle 446 mounted within receptacle 448. Flap 442 has a horizontal hook and eye fastener part mounted on its underside just inside its lip, for mating with a vertically aligned mating hook and eye fabric fastener part.

Figure 11:
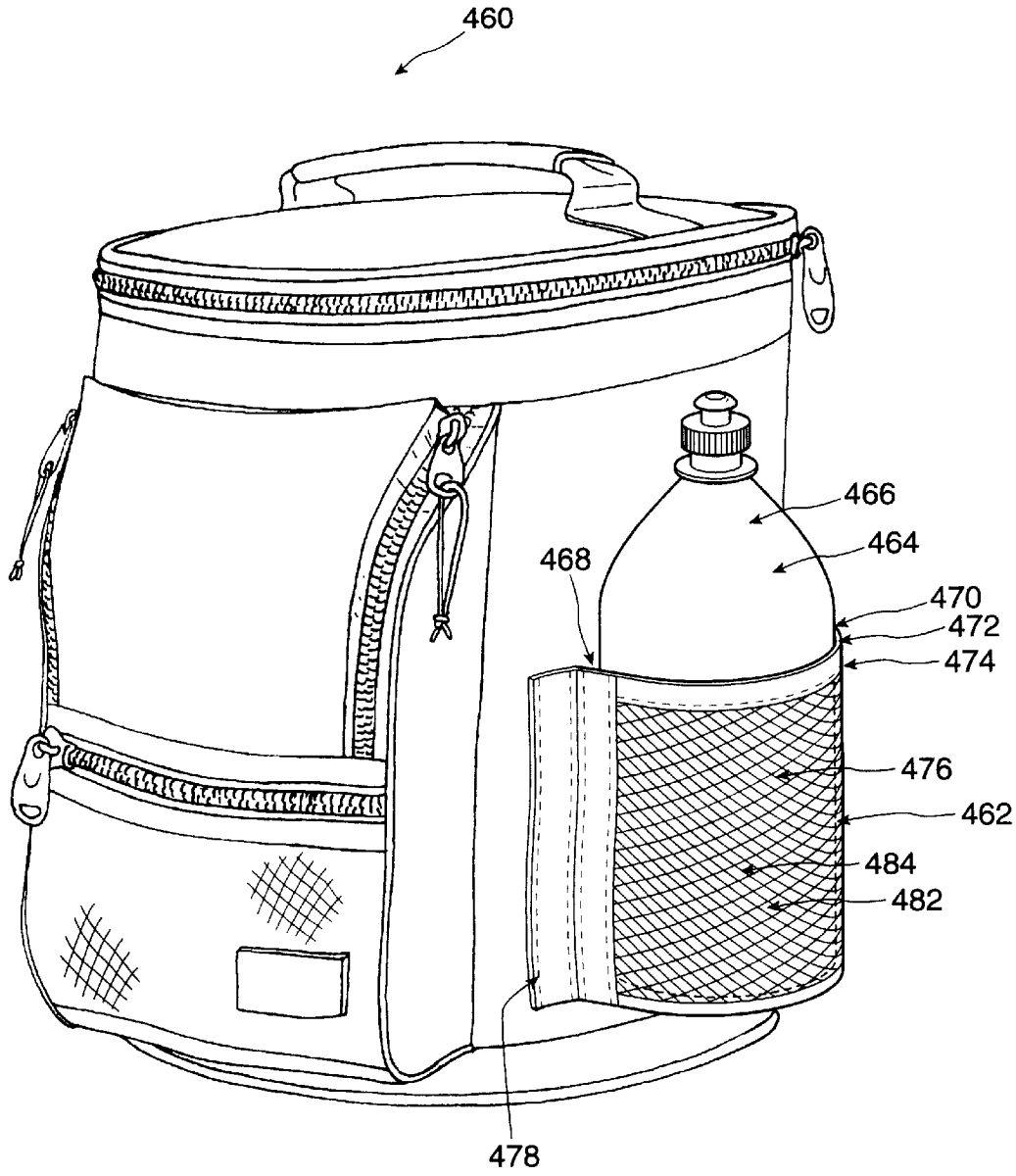
FIG. 11 is a further alternative embodiment to the pack of FIG. 8.

In an alternative embodiment illustrated in FIG. 11, insulated pack 460 has drink bottle 464 seated within receptacle 462. Top portion 466 of drink bottle 464 protrudes out of receptacle 462 through opening 468. Top portion 466 is exposed, that is, it is not covered or shaded. Rim 470 extends about top edge 472 of receptacle 462 adjacent opening 468. Rim 470 has a resilient member in the nature of an elastomeric band 474 that engages the circumference of drink bottle 464 and tends to encourage retention of drink bottle 464 within receptacle 462. Upstanding wall member 476 extends between vertical margins 478 to form the structure of receptacle 462, not unlike upstanding wall member 370 of receptacle 360. However, upstanding wall member 476 has a see-through web mesh 482 located at medial section 484. In this embodiment, receptacle 462 is not provided with a thermally insulative layer.

Figure 12:
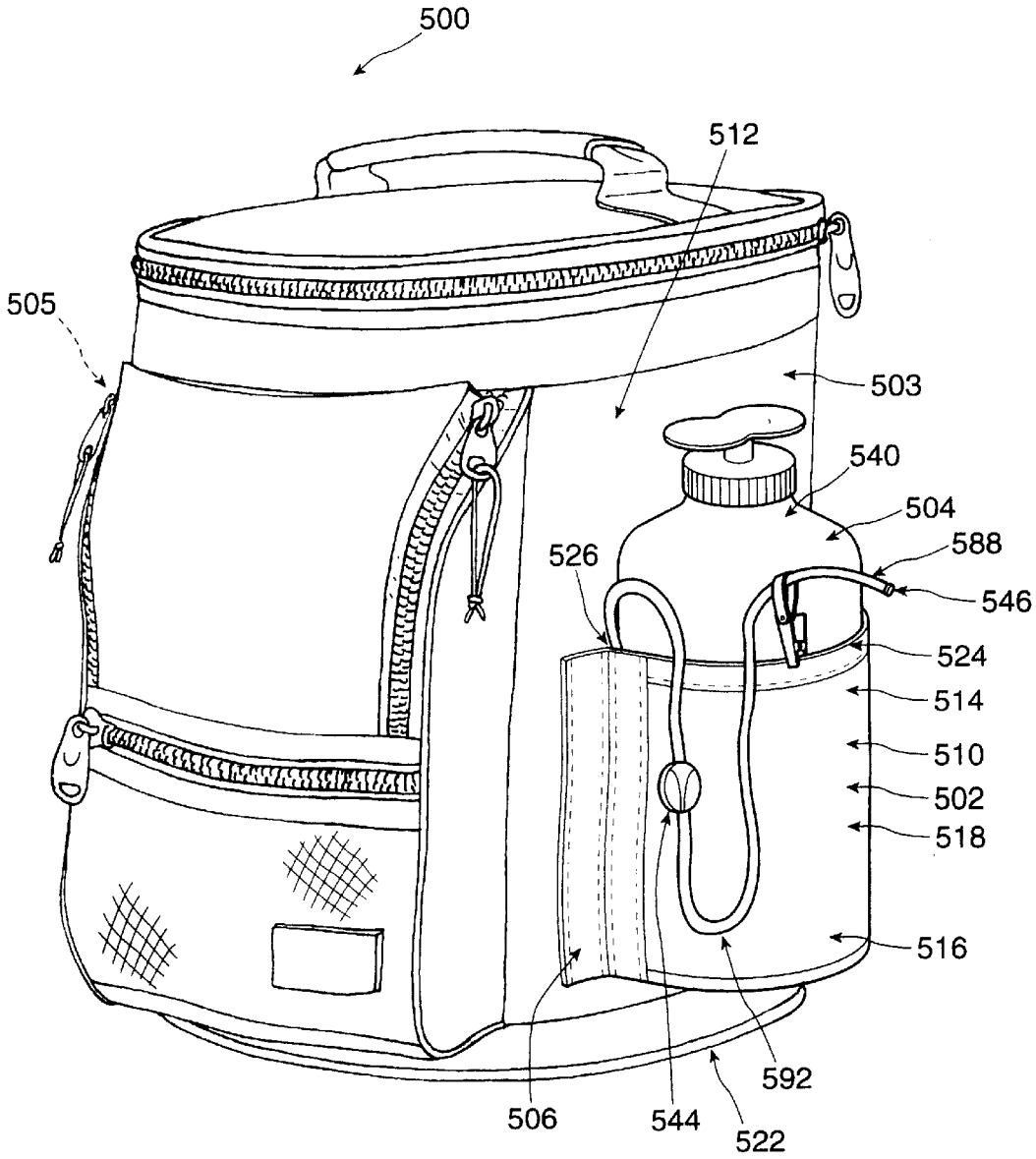
FIG. 12 shows a general arrangement three quarter view of another alternate pack to that FIG. 1.
Figure 13:
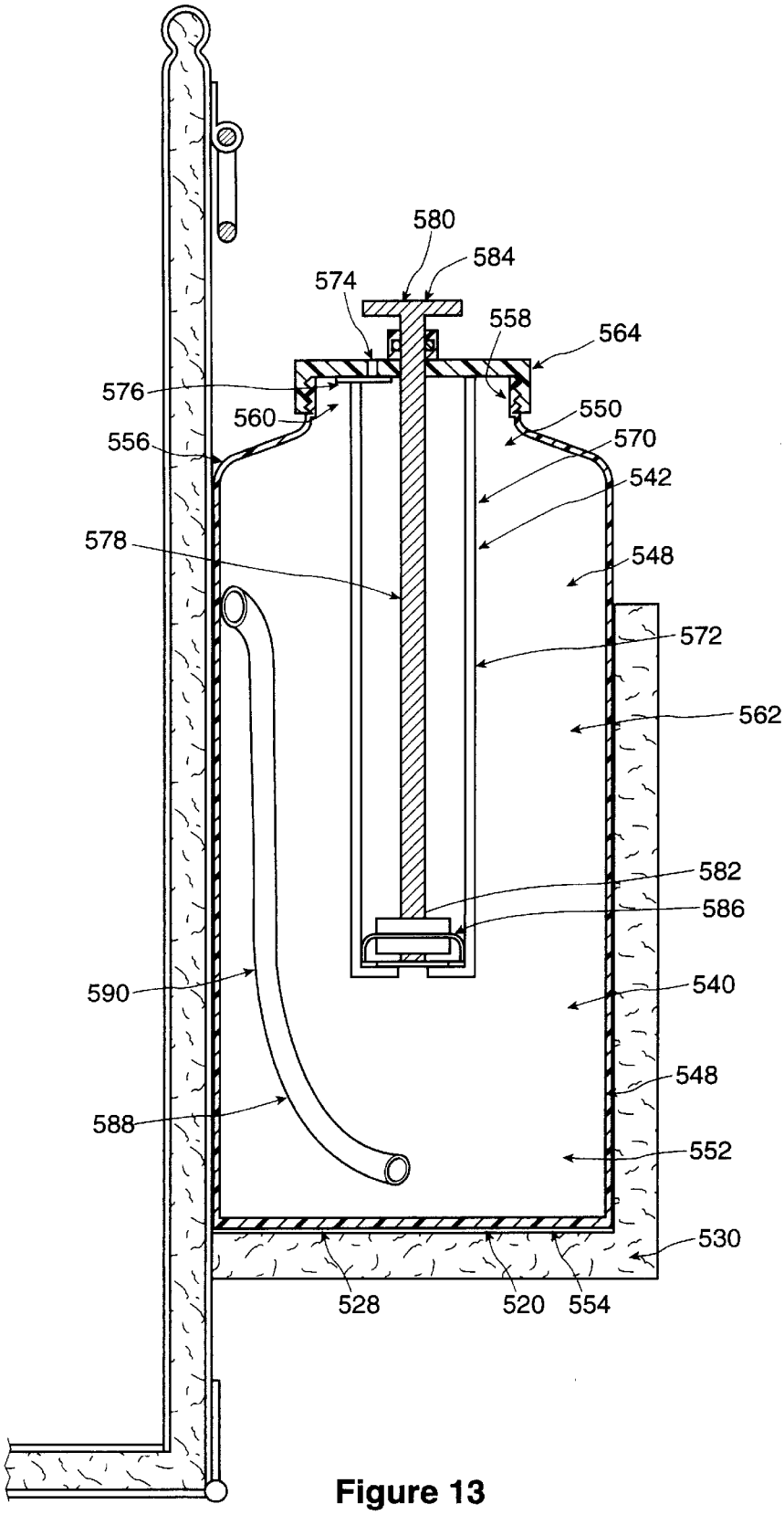
FIG. 13 is a partial cross-sectional view of FIG. 10 taken on section '13—13' showing a detail of a mister seated within a receptacle mounted on the pack.

Referring now to FIGS. 12 and 13, an additional alternative embodiment of an insulated pack is indicated generally as 500. Insulated pack 500 has a receptacle 502 for seating a misting apparatus in the nature of a mister 504. Receptacle 502 is mounted to one of side portions 503 and 505 of insulated pack 500. Receptacle 502 has a structure that is similar to receptacle 360 of FIG. 8. In particular, receptacle 502 has a pair of spaced apart, vertical margins 506, and an upstanding wall member 510 extending between margins 506. Margins 506 attach receptacle 502 to insulating wall 512. Upstanding wall member 510 has an upper region 514, a lower region 516 and a medial wall 518 extending between regions 514 and 516. Lower region 516 has a base 520 upon which mister 504 can rest when seated within receptacle 502. As can be seen in FIG. 12, base 520 is carried at a location higher than bottom 522 of insulated pack 500.

Rim 524 located about the uppermost edge of upper region 514 defines an opening 526 which gives access to a chamber 528 defined within receptacle 502. Mister 504 is mounted within chamber 528 in an upright position. The height of receptacle 502 is less than the total height of mister 504 such that mister 504 protrudes from receptacle 502 through opening 526. Receptacle 502 has a thermally insulative layer 530 to discourage heat transfer through the receptacle 502.

Mister 504 has a fluid reservoir 540, a compression apparatus 542 for pressurizing the fluid within reservoir 540, and a valve 544 for controlling the flow of pressurized fluid through a spray nozzle 546. Examining each of these components in greater detail, reservoir 540 has a generally cylindrical body 548. Body 548 has a top portion 550 and a bottom portion 552. Bottom portion 552 has a footing 554 which rests upon base 520 of receptacle 502. Top portion 550 has a transition section 556 from the broad profile of body 548 to an externally threaded neck or spout 558. Spout 558 defines an aperture 560 which gives access to a fluid chamber 562 within reservoir 540. An internally threaded cap 564 mates with threaded spout 558 to seal fluid chamber 562. Cap 564 is removable to allow for the filling of fluid chamber 562 with a fluid.

Compression apparatus 542, in the nature of a manual air pump 570, is mounted to cap 564. Pump 570 has a tubular cylinder 572 which extends into fluid chamber 562. One end of cylinder 572, is mounted to the underside of cap 564. A vent 574 is defined within cap 560 to allow air from the outside to enter cylinder 572. At the other, opposite, end of cylinder 572, there is a one-way valve 576 which allows passage of air from cylinder 572 to fluid chamber 562. A ram or push rod 578 extends through an opening in cap 564 into cylinder 572. Push rod 578 has a top end 580 and a bottom end 582. A handle 584 is mounted to top end 580 to facilitate manual actuation of pump 570. A seal 586 mounted to bottom end 582 creates an airtight seal with cylinder 572 such that on the down stroke of push rod 578, air is forced into fluid chamber 562, thus pressurizing the contents.

A flexible tube 588 has an inner portion 590 mounted within fluid chamber 562 and an outer portion 592 which extends outwardly from fluid chamber 562, and externally of reservoir 540. Tube 588 carries pressurized fluid from fluid chamber 562 to valve 544 and connects valve 544 to spray nozzle 546. Valve 544 activates the flow of pressurized fluid through spray nozzle 546.

Figure 14:
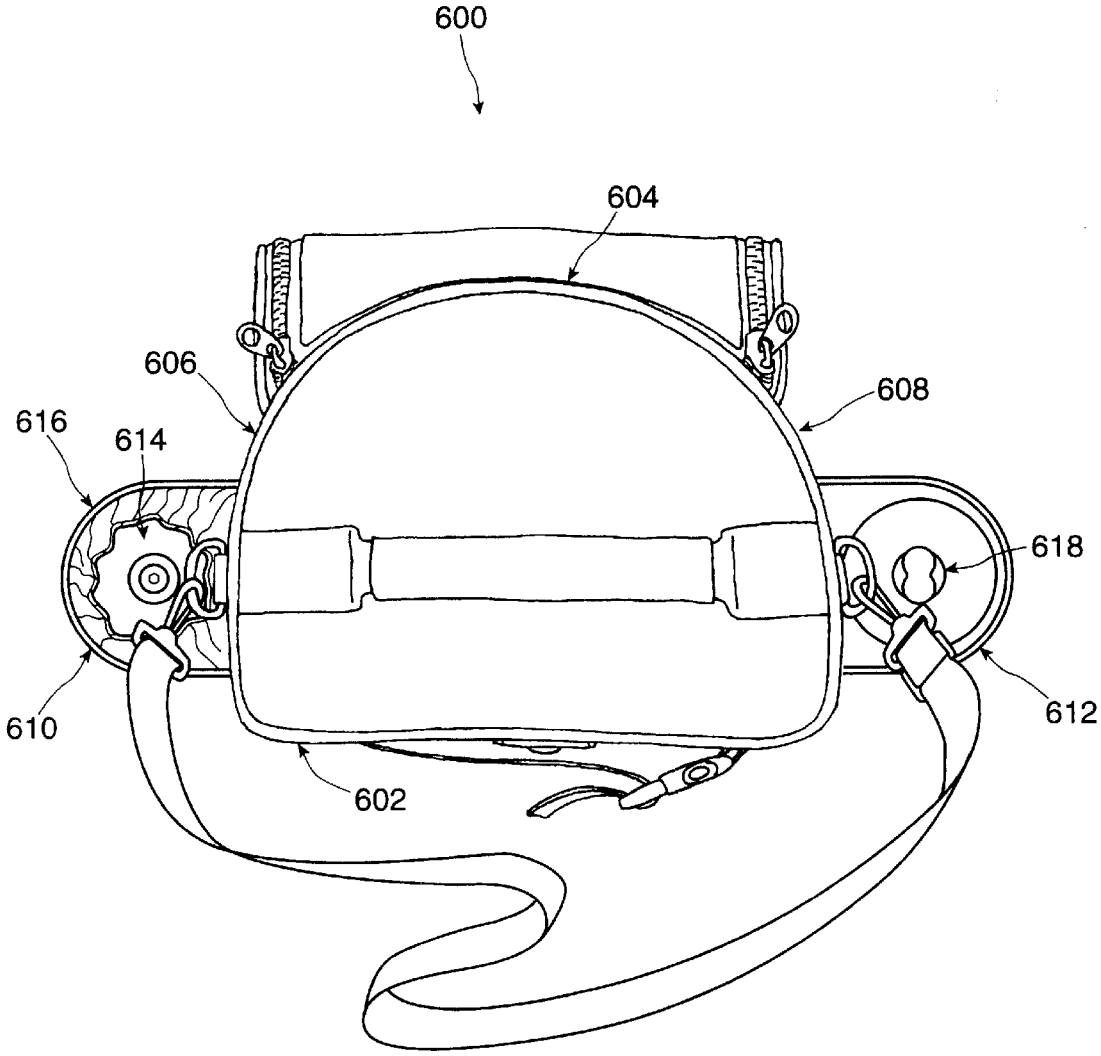
FIG. 14 shows a top plan view of an alternate pack to that of FIG. 1.

Referring now to FIG. 14, another embodiment of an insulated pack is indicated generally as 600. Insulated pack 600 is of generally similar construction to pack 300. Insulated pack 600 has a leading portion 602, a trailing portion 604, and a pair of left and right hand side portions 606 and 608. Insulated pack 600 has a first receptacle 610 mounted to left hand side portion 606 and a second receptacle 612 mounted to right hand side portion 608. A drink bottle 614, similar to drink bottle 364 described above, is seated within first receptacle 610. First receptacle 610 has generally the same structure as receptacle 360 of insulated pack 300, and includes a covering or sheltering member 616. A mister 618, not unlike mister 504 described above, is mounted within second receptacle 612. Second receptacle 612 is generally similar to receptacle 502 of insulated pack 500 described earlier.

A preferred embodiment has been described in detail and a number of alternatives have been considered. As changes in or additions to the above described embodiments may be made without departing from the nature, spirit or scope of the invention, the invention is not to be limited by or to those details, but only by the appended claims or their equivalents.

I claim:

1. A cooler comprising:

top, a bottom, and a flexible insulated sidewall extending therebetween to define an insulated compartment therewithin, said insulated sidewall having a height and a breadth; said height being greater than said breadth;

said insulated sidewall having a first portion and an arcuate second portion attached thereto;

said first and second portions defining a D-shaped cylinder extending between said bottom and said top;

said insulated sidewall having a lower margin mating with said bottom, and an upper margin distant from said bottom;

said top being attached to said upper margin, a portion of said top being moveable to an open position to permit objects to be placed in said insulated compartment; and a receptacle mounted to, and standing at least partially outwardly of, said insulated sidewall; said receptacle being accessible from outside said insulated sidewall.

2. The cooler of claim 1 wherein:

said receptacle includes an upstanding wall member mounted to said insulated sidewall;

said upstanding wall member has an upper region and a lower region; and said upper region defines at least a portion of an opening by which objects can be introduced into said receptacle.

3. The cooler of claim 2 wherein said receptacle has a base having a peripheral edge, and said lower region of said insulated sidewall is attached to at least a portion of said peripheral edge of said base.

4. The cooler of claim 3 wherein said peripheral edge is arcuate.

5. The cooler of claim 1 wherein said receptacle is an open-topped receptacle, said open-topped receptacle having a retaining member for engaging an object introduced therein.

6. The cooler of claim 5 wherein said retaining member is a resilient member mounted in a position to engage an object introduced into said receptacle.

7. The cooler of claim 6 wherein said receptacle has a top peripheral rim defining an opening in said receptacle, and said resilient member is a resilient band mounted about said top peripheral rim.

8. The cooler of claim 1 wherein said receptacle has an opening defined therein, said insulated sidewall has a cover member attached thereto; and said cover member is moveable to overlie said opening of said receptacle.

9. The cooler of claim 8 wherein said cover member is a flap and said flap has a closure member to secure said flap to said receptacle.

10. The cooler of claim 2 wherein said receptacle has a shrouding member mounted externally thereto.

11. The cooler of claim 10 wherein said shrouding member includes a collar and a drawstring operable to urge said collar to a closed position.

12. The cooler of claim 2 wherein a portion of said upstanding wall member is a see-through mesh web.

13. The cooler of claim 2 wherein said upstanding wall member is insulated.

14. A cooler comprising:

a top, a bottom, and a flexible insulated sidewall extending therebetween to define an insulated compartment therewithin, said insulated sidewall having a height and a breadth; said height being greater than said breadth;

said insulated sidewall having a first portion and an arcuate second portion attached thereto;

said first and second portions defining a D-shaped cylinder extending between said bottom and said top;

said second, arcuate portion having a first side region bordering said first portion, a second, opposed side region bordering said first portion, and a medial region between said first and said second side regions; said media region being generally opposed to said first portion;

said insulated sidewall having a lower margin mating with said bottom, and an upper margin distant from said bottom;

said top being attached to said upper margin, a portion of said top being moveable to an open position to permit objects to be placed in said insulated compartment; and an open-topped receptacle mounted to, and standing at least partially outwardly of, said insulated sidewall; said receptacle being accessible from outside said insulated sidewall.

15. The cooler of claim 14 wherein said receptacle is mounted to said first side region of said second, arcuate portion.

16. The cooler of claim 15 further comprising a second open-topped receptacle; said second receptacle being mounted to said second side region of said second, arcuate portion.

17. The cooler of claim 15 further comprising an auxiliary enclosure structure; said auxiliary enclosure structure being mounted to said medial region of said second, arcuate portion of said insulated sidewall and extending outwardly thereof.

18. The cooler of claim 16 further comprising an auxiliary enclosure structure; said auxiliary enclosure structure being mounted between said first and said second receptacles.

19. The cooler of claim 14 wherein said receptacle has right and left hand side edges extending vertically along said insulated sidewall for mounting said receptacle to said insulated sidewall, and a wall structure extending between said side edges; a portion of said wall structure defining a chamber therewithin; said chamber being shaped to receive a cylindrical object therewithin.

20. A cooler assembly comprising:

an insulated wall structure having a top, a bottom, and a flexible insulated sidewall extending therebetween to define an insulated compartment therewithin, said insulated sidewall having a height and a breadth; said height being greater than said breadth;

said insulated sidewall having a first portion and an arcuate second portion attached thereto;

said first and second portions defining a D-shaped cylinder extending between said bottom and said top;

a portion of said insulated wall structure being moveable to an open position to permit objects to be placed in said insulated compartment;

a receptacle mounted to said insulated sidewall; and a vessel for containing liquid removeably mounted within said receptacle.

21. The cooler assembly of claim 20 wherein said receptacle stands at least partially outwardly of said insulated sidewall.

22. The cooler assembly of claim 20 wherein said receptacle has a chamber defined therein; said chamber being accessible from outside said insulated sidewall.

23. The cooler assembly of claim 22 wherein said chamber has an impermeable liner mounted therewithin.

24. The cooler assembly of claim 20 wherein said receptacle includes a thermally insulative layer for discouraging heat transfer through said receptacle.

25. The cooler assembly of claim 20 wherein said receptacle has a wall structure and said wall structure has a peripheral rim thereabout; a portion of said peripheral rim defining an opening within said receptacle; at least a portion of said vessel outwardly protruding from said opening.

26. The cooler assembly of claim 20 wherein said receptacle has a member located to shelter said vessel.

27. The cooler assembly of claim 26 wherein said member is a shroud member; said shroud member having a collar and a drawstring operable to urge said collar to engage at least a portion of said vessel protruding outwardly from said receptacle.

28. The cooler assembly of claim 20 further comprising a shading member to cover said vessel.

29. The cooler assembly of claim 20 wherein said vessel is a vessel selected from the group consisting of a drink bottle and a mister.

30. A cooler assembly comprising:

an insulated wall structure having a top, a bottom, and a flexible insulated sidewall extending therebetween to define an insulated compartment therewithin, said insulated sidewall having a height and a breadth; said height being greater than said breadth;

said insulated sidewall having a first portion and an arcuate second portion attached thereto;

said first and second portions defining a D-shaped cylinder extending between said bottom and said top;

a portion of said insulated wall structure being moveable to an open position to permit objects to be placed in said insulated compartment;

a receptacle mounted to said insulated sidewall;

a mister removeably mounted within said receptacle; said mister having, a liquid reservoir;

a pressurization apparatus removeably mounted to said reservoir;

a spray nozzle in fluid communication with said reservoir; and a valve operable to control the flow of liquid to said spray nozzle.

31. The cooler of claim 30 wherein said pressurization apparatus includes a manual air pump.

32. The cooler assembly of claim 30 wherein said receptacle has a thermally insulative layer for discouraging heat transfer through said receptacle.

33. The cooler assembly of claim 30 further comprising:

a second receptacle mounted to said insulated sidewall; and a second vessel for containing liquid, removeably mounted within said second receptacle.

34. The cooler assembly of claim 31 wherein said second receptacle stands at least partially outwardly of said insulated sidewall.

35. The cooler assembly of claim 34 wherein said first and said second receptacles are mounted to said second, arcuate portion of said insulated sidewall in a saddle bag arrangement.

36. The cooler assembly of claim 33 wherein said first vessel is a drink bottle and said second vessel is a mister.

37. A cooler assembly comprising:

an insulated wall structure having a top, a bottom, and a flexible insulated sidewall extending therebetween to define an insulated compartment therewithin, said insulated sidewall having a height and a breadth; said height being greater than said breadth;

said insulated sidewall having a first portion and an arcuate second portion attached thereto;

said first and second portions defining a D-shaped cylinder extending between said bottom and said top;

a portion of said insulated wall structure being moveable to an open position to permit objects to be placed in said insulated compartment;

a receptacle mounted to said insulated wall structure; and a spraying apparatus mounted to said receptacle.

38. The cooler assembly of claim 31 wherein said spraying apparatus includes:

a liquid reservoir removeably mounted in said receptacle;

a spray nozzle in fluid communication with said reservoir; and apparatus mounted in fluid communication with said reservoir to urge liquid to flow from said reservoir to said nozzle.

39. The cooler assembly of claim 31 wherein said spraying apparatus includes a valve mounted to control flow through said nozzle.

40. The cooler assembly of claim 31 wherein said spraying apparatus includes a pump operable to urge said liquid from said reservoir to said nozzle.

* * * * *

US006439389C1

(12) EX PARTE REEXAMINATION CERTIFICATE (6485th)

United States Patent

Mogil

(10) Number: US 6,439,389 C1

(45) Certificate Issued: *Oct. 21, 2008

(54) PACK ASSEMBLY

(75) Inventor: Melvin S. Mogil, Toronto (CA)

(73) Assignee: California Innovations Inc., Toronto Ontario (CA)

Reexamination Request:
No. 90/008,717, Jun. 19, 2007

Reexamination Certificate for:

| | |
|---|---|
| Patent No.: | **6,439,389** |
| Issued: | **Aug. 27, 2002** |
| Appl. No.: | **09/617,045** |
| Filed: | **Jul. 14, 2000** |

( * ) Notice: This patent is subject to a terminal disclaimer.

Related U.S. Application Data

(63) Continuation-in-part of application No. 09/568,022, filed on May 10, 2000, now Pat. No. 6,237,776, which is a continuation of application No. 09/122,088, filed on Jul. 24, 1998, now Pat. No. 6,092,661.

(51) Int. Cl.

| | |
|---|---|
| ***A45F 3/02*** | (2006.01) |
| ***A45C 11/20*** | (2006.01) |
| ***A45C 13/00*** | (2006.01) |
| ***A45C 3/00*** | (2006.01) |
| ***B65D 69/00*** | (2006.01) |

(52) U.S. Cl. ..... 206/579; 206/217; 206/315.1; 206/523

(58) Field of Classification Search ..... None
See application file for complete search history.

(56) References Cited

U.S. PATENT DOCUMENTS

| | | | | | |
|---|---|---|---|---|---|
| 4,468,933 | A | | 9/1984 | Christopher | |
| 5,114,059 | A | | 5/1992 | Thatcher | |
| D352,827 | S | | 11/1994 | Schildkraut | |
| 5,573,166 | A | | 11/1996 | Leja | |
| 5,649,658 | A | * | 7/1997 | Hoffman et al. | 224/576 |
| 5,842,571 | A | | 12/1998 | Rausch | |
| D406,729 | S | | 3/1999 | Freese et al. | |
| D419,830 | S | * | 2/2000 | Birutis et al. | D7/607 |

OTHER PUBLICATIONS

Artic Zone, "Get on Course with the Arctic Zone Golf Cooler" one sheet Arctic Zone 1996 outer Circle Products, Ltd. AZC–0696–D.

* cited by examiner

*Primary Examiner*—Peter C. English

(57) ABSTRACT

An insulated pack has a main, insulated compartment suitable for holding refreshments at either a warmed or chilled temperature. The insulated pack has an externally mounted receptacle for carrying a liquid containing vessel, in the nature of a drink bottle or a mister. It also has another compartment for valuables that has receptacles for such objects as cellular telephone handsets, wallets, and keys. It has a reinforced web framework structure, and a carrying handle mounted on the lid. Use of two of these packs, allows a user to keep different objects at different temperatures. The pack is particularly useful for attachment to a golf bag or golf cart to provide cool drinks during a round of golf.

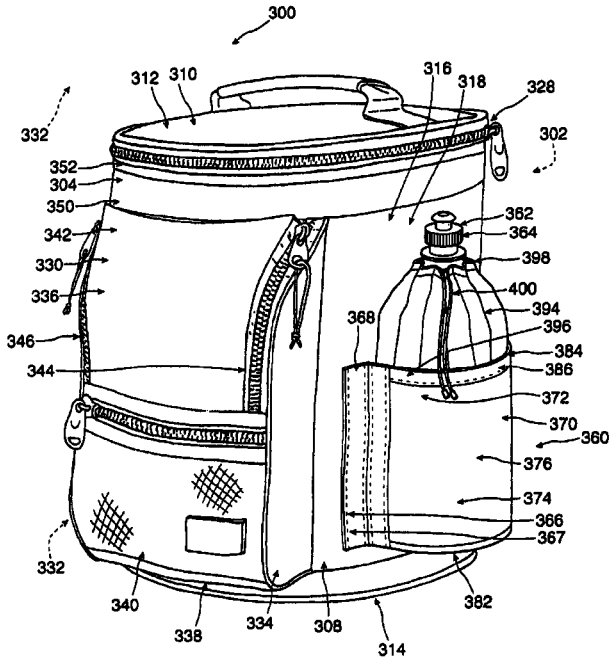

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–40 are cancelled.

* * * * *